US007562796B2

(12) United States Patent
Zahn et al.

(10) Patent No.: US 7,562,796 B2
(45) Date of Patent: Jul. 21, 2009

(54) DISPENSING CONTAINER WITH FLOW CONTROL SYSTEM

(75) Inventors: Walter Zahn, Columbia, SC (US); Shawn W. Miller, Columbia, SC (US); David Rocheleau, Lexington, SC (US); Mohammad R. Sadeghi, Columbia, SC (US); Bernd Hansen, Laufen (DE)

(73) Assignee: Holopack International Corp., Columbia, SC (US)

( * ) Notice: Subject to any disclaimer, the term of this patent is extended or adjusted under 35 U.S.C. 154(b) by 555 days.

(21) Appl. No.: 11/285,913

(22) Filed: Nov. 23, 2005

(65) Prior Publication Data

US 2006/0108384 A1 May 25, 2006

Related U.S. Application Data

(60) Provisional application No. 60/630,716, filed on Nov. 24, 2004.

(51) Int. Cl.
*B65D 47/10* (2006.01)

(52) U.S. Cl. ..... 222/541.9; 222/107; 222/215; 222/564; 215/11.4; 215/208

(58) Field of Classification Search ..... 222/92, 222/95, 104, 107, 206–210, 212–214, 541.9, 222/145.5–145.6, 459, 547, 564, 215; 215/11.1, 215/11.3–11.4, 208
See application file for complete search history.

(56) References Cited

U.S. PATENT DOCUMENTS

| | | | | |
|---|---|---|---|---|
| 201,369 | A | 3/1878 | Walker | |
| D24,197 | S | 4/1895 | Nye | |
| D34,314 | S | 4/1901 | Day | |
| 878,524 | A | 2/1908 | Gregory | |
| D52,688 | S | 11/1918 | Westbrook | |
| 1,661,595 | A | 3/1928 | Bowen | |
| 2,293,922 | A | 8/1942 | Serinis | 221/148 |
| 2,688,243 | A | 9/1954 | Bowen | 68/213 |
| RE24,251 | E | 12/1956 | Kaplan et al. | 222/107 |
| 2,795,043 | A | 6/1957 | Fleischer | 30/123 |
| 3,090,071 | A | 5/1963 | Brooy | 15/595 |
| 3,116,152 | A | 12/1963 | Smith | 99/171 |
| 3,133,679 | A | 5/1964 | Brown | 222/205 |
| 3,410,457 | A * | 11/1968 | Brown | 222/191 |
| 3,473,221 | A | 10/1969 | Flanders | 30/141 |
| 3,946,652 | A | 3/1976 | Gorin | 99/323 |
| 4,087,022 | A | 5/1978 | Zanetti-Streccia | 222/183 |

(Continued)

OTHER PUBLICATIONS

PCT International Search Report (ISR), International Application No. PC/US05/42576, International Filing Date Nov. 23, 2005, Date of actual completion of ISR Apr. 14, 2006, Date of mailing of ISR May 11, 2006.

*Primary Examiner*—Kevin P Shaver
*Assistant Examiner*—Andrew P Bainbridge
(74) *Attorney, Agent, or Firm*—Nelson Mullins Riley & Scarborough, LLP

(57) ABSTRACT

A dispensing container fillable with a liquid includes a squeezable reservoir for holding the liquid prior to dispensing, a dispensing outlet for expending the liquid, and a flow control system for regulating the velocity of the liquid exiting the outlet when a squeezing pressure is applied to the liquid-holding reservoir.

17 Claims, 15 Drawing Sheets

U.S. PATENT DOCUMENTS 4,161,264 A * 7/1979 Malmgren et al. ..... 222/135
4,182,002 A 1/1980 Holec ..... 17/30
4,192,360 A 3/1980 Rodriquez ..... 141/24
4,248,227 A 2/1981 Thomas ..... 128/232
4,411,656 A 10/1983 Cornett, III ..... 604/212
4,787,536 A * 11/1988 Widerstrom ..... 222/212
4,830,222 A 5/1989 Read ..... 222/106
4,841,637 A * 6/1989 Scholzen ..... 30/125
4,888,188 A 12/1989 Castner, Sr. et al. ..... 426/109
4,890,744 A 1/1990 Lane, Jr. et al. ..... 206/632
4,966,312 A 10/1990 Waring ..... 222/209
5,038,476 A 8/1991 McCrea ..... 30/141
5,038,974 A 8/1991 DaCosta ..... 222/106
5,062,550 A 11/1991 Singh ..... 222/80
5,154,318 A 10/1992 Lampard ..... 222/105
5,158,192 A * 10/1992 Lataix ..... 215/48
D368,209 S 3/1996 Decker ..... D7/653
5,556,008 A 9/1996 Silver et al. ..... 222/192
5,975,305 A 11/1999 Barger ..... 206/572
6,347,727 B1 2/2002 Diaz ..... 222/101
6,357,450 B1 3/2002 Paice ..... 132/114
6,357,626 B1 * 3/2002 Zhang et al. ..... 222/78
D496,833 S 10/2004 Lantz ..... D7/653
6,868,987 B2 * 3/2005 Hedington et al. ..... 222/95
7,487,894 B2 * 2/2009 Zahn et al. ..... 222/541.9
7,513,397 B2 * 4/2009 Zahn et al. ..... 222/541.9
2007/0138215 A1 * 6/2007 Zahn et al. ..... 222/541.9

* cited by examiner

DISPENSING CONTAINER WITH FLOW CONTROL SYSTEM

CROSS-REFERENCE TO RELATED APPLICATION

This application is a non-provisional patent application of U.S. Provisional Patent Application No. 60/630,716, filed Nov. 24, 2004, and titled DISPENSING CONTAINER, which is incorporated by reference herein in its entirety.

BACKGROUND OF THE INVENTION (1) Field of the Invention

The present invention relates to a flow-control system for a container for dispensing a liquid, and more particularly to a flow-control system for dispensing a measured amount of a liquid at a controlled rate.

(2) Description of the Related Art

Various dispensers for dispensing a liquid are known in the art. For example, various containers may be employed for dispensing liquids such as soap, eye wash, shampoo, ear wash, mouthwash, and medicine. These containers generally employ a flexible plastic reservoir portion for holding the liquid that can be squeezed to apply pressure to the liquid contained therein for transporting the liquid toward a dispensing opening or outlet. Typically, these devices will employ a large reservoir for holding liquid that is in communication with a single outlet such as a hole. When pressure is applied to the liquid-holding reservoir, the liquid is then expended from the container through the opening.

Often, overexertion of pressure on the reservoir will cause the liquid to be dispensed at a rate that is not suitable for the use of the container. For example, when the container holds eye wash or ear wash, an over-application of pressure to the reservoir will result in a hard stream of liquid that could result in agitation to, and perhaps injury to, the eye, nasal septum, or eardrum.

In addition, it has long been recognized that the requirements for administering liquids in accurate amounts, such as is required for medicines, drugs, vitamins, and the like, are different than for the consumption of foods. This is particularly true where the subject is a child or infant. In the case of medicines, the amount of the liquid must be carefully controlled, and care must be taken to insure that the entire dose is successfully administered. When the subject is an infant, consumption may not be voluntary, and spillage is a danger. Moreover, when an infant is to receive the liquid, great care must be taken to avoid over-insertion of a dosing device into the mouth and throat, thereby causing choking.

Furthermore, it is important to avoid the discharge of liquid into the throat, of a child or infant at a rate that will startle the child, or result in choking or involuntary gagging. This potential exists when pressure is misapplied to the reservoir holding the liquid. On the other hand, application of a liquid medicine into the front of the mouth of a child will often result in loss of some or all of the medicine by spitting or drooling.

In response to these requirements, various devices have been described that are designed to address one or more of the particular requirements. For example, dispensing devices having open, spoon-like bowls in which a liquid is offered are described in U.S. Pat. Nos. 2,795,043, 4,888,188, 6,264,074, 5,154,318, 5,975,305, 4,841,637, 3,133,679, 3,473,221, 4,192,360, 4,830,222, 6,347,727, 3,946,652, D496,833, 3,116,152, among others. Such devices, however, in most cases, require the subject receiving the contents to voluntarily accept and remove the contents of the bowl when presented.

Spoons that provide for dispensing a liquid at or near the distal end of the bowl are described in U.S. Pat. Nos. 2,688,243, 5,038,974, 5,038,476, 201,369, D34,314, D52,688, D24,197 and D368,209. Many of these devices appear to depend upon either gravity, or an action by the recipient, to deliver the contents of the device.

Feeding devices or injecting devices having multiple parts, and which are designed for refilling and reuse, are described in U.S. Pat. Nos. 4,880,409, 5,556,008, 878,524, 1,661,595, 3,090,071, 3,410,457, 4,182,002, 5,062,550, among others.

Other pre-filled disposable containers are described in U.S. Pat. No 6,357,626.

Systems and designs that may control or limit the flow rate of liquids from certain containers are described in U.S. Pat. Nos. 4,087,022, 878,524, 1,661,595, 3,410,457, 4,182,002, 5,062,550, 5,154,318, 6,357,450, 2,293,922, 3,133,679, 4,192,360, 6,347,727, R24,251, and 4,890,744.

Yet, with the advances of the prior art, several problems remain to be overcome. It would be beneficial if a flow control mechanism could regulate the flow of liquid through the dispensing outlet so that the liquid contents could be delivered into the back of the mouth of the user, when the device is used to deliver a liquid orally, to minimize loss of the liquid by spitting or drooling, but yet at a velocity that is sufficiently low to avoid triggering a gagging reflex.

In addition, for certain uses, it would be useful to provide a dispensing container that did not have multiple parts and that could be made simply and inexpensively. It would also be useful if such dispensing container could be disposed after a single use. It would be useful if such a container could be designed to avoid requiring the user or another person to fill the container and/or measure the amount of liquid to be dosed, thereby improving accuracy, avoiding mistakes, and reducing waste. It would additionally be useful if such a container protected the integrity of the contents during packaging, transporting, selling and storage.

It would be particularly useful if the dispensing containers could be utilized in a safe manner that does not have the potential for aggravating the area to which the liquid is being applied. Furthermore, it would be useful if such dispensing container could be safely used when dispensing oral, ear, nasal, or eye medicaments, such as with infants. Controlling flow of the liquid from the container as well as avoiding over-insertion of the container into the mouth of an infant and thereby protecting against choking would likely result in a safe application of the liquid to an infant.

SUMMARY OF THE INVENTION

Briefly, therefore the present invention is directed to a novel flow-controlled dispensing container fillable with a liquid, the container comprising: a squeezable reservoir for holding the liquid prior to dispensing; an outlet that is interconnected with the reservoir by a passage at an inlet, wherein the outlet is sealed with a breakable seal which reveals the outlet when broken; and a flow control system comprising the inlet to the passage, the passage, and the outlet that dispenses the liquid at a desired outlet velocity and within a desired delivery time when the squeezable reservoir is squeezed.

The present invention is also directed to a novel method of making a flow-controlled dispensing container having a liquid therein, the method comprising: extruding a polymer into a blow mold; closing the mold; forming a dispensing container comprising a squeezable reservoir for holding the liquid prior to dispensing, an outlet that is interconnected with the reservoir by a passage at an inlet, wherein the outlet is sealed with a breakable seal which reveals the outlet when broken, and a flow control system comprising the inlet to the passage, the passage, and the outlet that dispenses the liquid at a desired outlet velocity and within a desired delivery time when the squeezable reservoir is squeezed; adding the liquid to the dispensing container; sealing the dispensing container; and removing the sealed pre-filled dispensing container from the mold.

Among the several advantages found to be achieved by the present invention, therefore, may be noted the provision of a dispensing container where the dispensing flow of the liquid is controlled to provide the liquid contents to the recipient at a desirable velocity and within a desirable period. In addition, the certain embodiments provide advantages where a container can be unitary without multiple parts, and which can be made simply and inexpensively, the provision of a dispensing container that can be disposable after a single use, the provision of a dispensing container that avoids the requirement of filling the container and/or measuring the amount of liquid to be dosed, thereby improving accuracy, avoiding mistakes, and reducing waste, the provision of a dispensing container that protects the integrity of the contents during packaging, transporting, selling and storage, and the provision of a dispensing container that can be safely used with infants, in particular a container that avoids over-insertion into the mouth, nose, ear, or eye of the infant and thereby protects against choking, and provides a flow control system for controlling the rate of discharge of the liquid into the mouth, ear, eye, or nose of the user.

BRIEF DESCRIPTION OF THE DRAWINGS

FIG. 1 illustrates an embodiment of the present flow-controlled dispensing container having a disk-shaped central passage, where

FIG. 2 illustrates an embodiment of the present flow-controlling dispensing container similar to that shown in FIG. 1 that is filled with a liquid, where

FIG. 3 illustrates an embodiment of the present flow-controlled dispensing container in which the passage is a single cylindrical channel of varying internal diameter, where

FIG. 4 illustrates an embodiment of the present flow-controlled dispensing container having a single square-ended zig-zag passage, where

FIG. 5 illustrates an embodiment of the present flow-controlled dispensing container having a passage comprising multiple irregular channels that meet at a single inlet and a single outlet, where

FIG. 6 illustrates an embodiment of the present flow-controlled dispensing container having a passage having an inlet with a different cross-section area than the outlet, where

FIG. 7 illustrates an embodiment of the present flow-controlled dispensing container having a passage with a single inlet that splits into multiple channels, each channel having its own separate outlet, where

FIG. 8 illustrates an embodiment of the present flow-controlled dispensing container having an irregularly shaped single channel passage, where

FIG. 9 illustrates an embodiment of the present flow-controlled dispensing container having a serpentine passage, where

FIG. 10 illustrates an embodiment of the present flow-controlled dispensing container having split circumferential passages, where

FIG. 11 illustrates an embodiment of the present flow-controlled dispensing container having a central passage defined by indentations in the top and bottom of the dispensing head, where

FIG. 12 illustrates an embodiment of the present flow-controlled dispensing container having a passage that is roughly in the shape of an "S" and which is formed by indentations in the top and bottom of the dispensing head, where

FIG. 13 illustrates an embodiment of the present flow-controlled dispensing container having a passage that is roughly in the shape of a "Z" that is formed by indentations in the dispensing head, and also having additional raised sections of the dispensing head, where

Corresponding reference characters indicate corresponding parts throughout the several views of the drawings.

DETAILED DESCRIPTION OF THE PREFERRED EMBODIMENTS

Figure 1A:
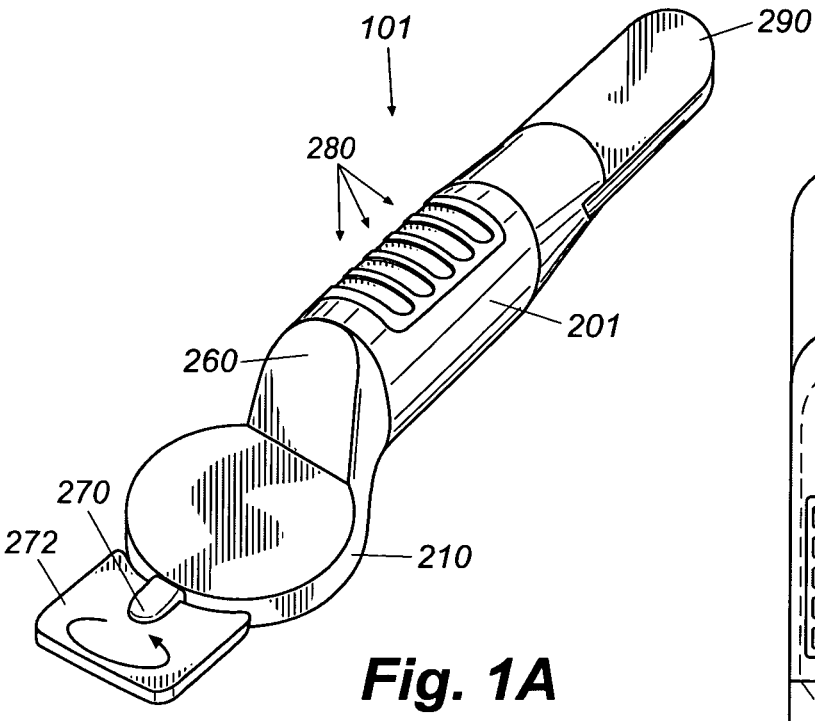
FIG. 1A shows a perspective view.
Figure 1B:
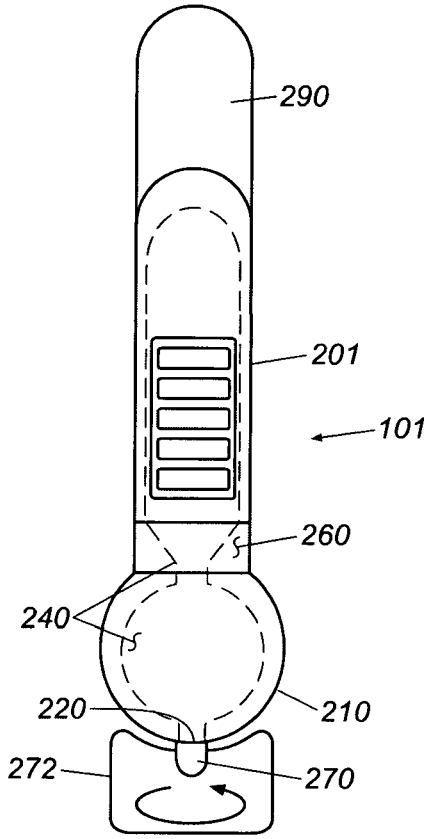
FIG. 1B shows a top elevation view.
Figure 1C:
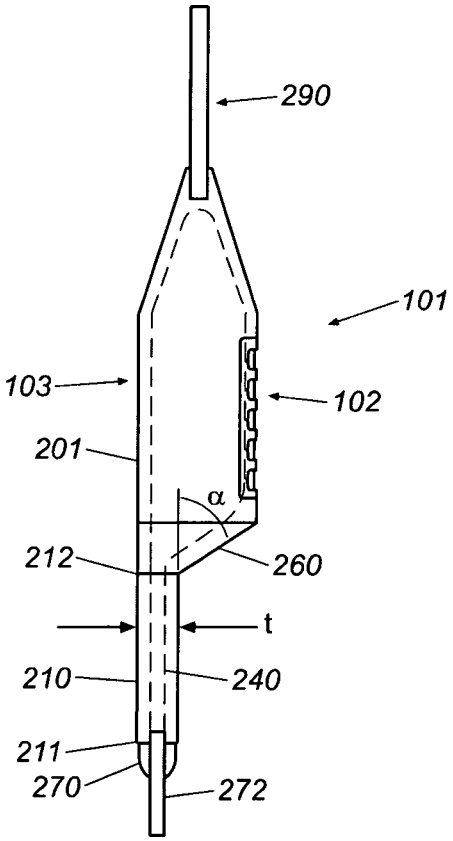
FIG. 1C shows a left side elevation view.
Figure 1D:
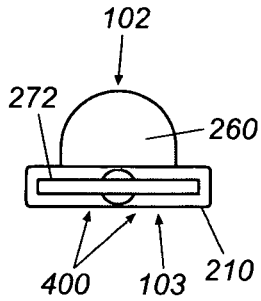
FIG. 1D shows a front end elevation view.

In accordance with the present invention, it has been discovered that a novel dispensing container having a flow control system can be produced that has several advantages over earlier dispensing containers. The present dispensing container is fillable with a liquid to be dispensed to a user at a velocity and over a period of time that are designed to effectively and easily deliver a measured amount of liquid to a user.

As used herein, the term "user" means a subject who receives the liquid contained in the device. In other words, the user is the subject to whom the liquid of the device is administered. For example, the user can be a human who employs the liquid contained in the container as an ear wash, an eye wash, a mouth wash, or the like. In addition, the user can be an animal to which certain liquids are applied. Such animals include farm and domesticated animals such as dogs, horses, cats, pigs, and the like. In other embodiments, the user can be an adult, child or infant to which a liquid medicine is being administered.

The contents of the device can be self-administered by the user or administered by another to the user. For example, the device can be operated by an adult to administer medicine to a user, who could be a child or an infant. In addition, the contents can be administered by a human to an animal.

In one particular embodiment, the present container is fillable with a liquid and the liquid is held in the device in a squeezable reservoir prior to dispensing. The container includes a dispensing outlet that is interconnected with the reservoir by a passage. The passage is connected to the reservoir at an inlet. The outlet is constructed for dispensing the liquid from the container. In the present invention, a flow control system that can include the inlet, the passage, and the outlet is employed to control the velocity of the liquid exiting the outlet when the dispensing container is squeezed by applying pressure to the reservoir portion of the flexible container. The flow control system is also designed to permit the liquid in the squeezable reservoir to be delivered within a desired delivery time.

As used herein, the terms "outlet velocity" refer to the linear velocity at the outlet of the stream of liquid exiting the outlet when the squeezable reservoir is squeezed. The terms "delivery time" refer to the time that it takes for a normal adult human being to fully squeeze the squeezable reservoir one time and for the reservoir to substantially recover its original shape after the squeezing pressure is released. In other words, the delivery time includes one squeeze and release cycle. Because it may take two or more squeeze and release cycles to fully empty the contents of the reservoir, the time to empty the reservoir may be two or more times the delivery time.

In a particular embodiment of the present invention that is useful for administering liquid medicine orally to children or infants, the present container includes a squeezable reservoir for holding the liquid prior to dispensing and a substantially flat dispensing head which is integral with the squeezable reservoir and which has an outlet at its distal end for dispensing the liquid from the container. A passage interconnecting the squeezable reservoir and the outlet leads the liquid to the outlet, and a stop disposed near the proximal end of the dispensing head prevents over-insertion of the dispensing head into a user's mouth when the container is used to dispense the liquid contents.

The scope of the present invention is intended to include dispensing containers that are fillable with a liquid, and also those that include liquid contents (pre-filled containers). Also included is a method of producing the container having the novel flow control system.

A dispensing container having the present flow control system can be described with reference to the several figures that accompany this specification. As shown in FIGS. 1A-1D to FIGS. 13A-13D, a dispensing container [101] comprises a squeezable reservoir [201] for holding a liquid prior to dispensing; a dispensing head [210] which is integral with the squeezable reservoir and having a distal end [211] and a proximal end [212]; an outlet [220] at the distal end of the dispensing head for dispensing the liquid from the container; a passage [240] interconnecting the squeezable reservoir [201] and the outlet [220]; and a stop [260] disposed near the proximal end [212] of the dispensing head [210] to prevent over-insertion of the dispensing head into a user's mouth, ear, nose or other bodily part, when the container is used to dispense the liquid to the user.

While the dispensing heads [210] that are shown in FIGS. 1A-13D appear to have a roughly flat, rounded shape, it is particularly to be noted that the shape of the dispensing head is not limited to this shape, and the dispensing head can be advantageously shaped for delivery of liquids to the ear or eye, or any other location of a human or animal body. The present flow control system can be utilized with any shape of the dispensing head.

In a preferred embodiment, the present dispensing container [101] is unitary. In other words, all parts of the dispensing container are integral with each other. In fact, as will be discussed in detail below, all parts of the container are preferably formed at substantially the same time by a blow-fill-seal process from a single piece of material with all parts integral and continuous.

After the liquid contents of the container have been added to the squeezable reservoir [201], it is desirable that the outlet [220] is closed by a breakable seal [270] which reveals the outlet [220] when the seal is broken. The breakable seal [270] is preferably formed as an integral part of the dispensing head [210] at the same time as, or immediately after, the dispensing head itself is formed. In order to facilitate the easy removal of the breakable seal [270], it is preferred that the breakable seal is integral with a tab [272] which is designed for gripping between the thumb and forefinger for the purpose of breaking the seal. In one embodiment, for example, the user, or person administering the liquid, could break the seal by gripping the tab between thumb and forefinger, and applying a twisting motion. Breakage of the breakable seal [270] reveals the outlet [220] and permits the liquid [301] to exit the dispensing container [101] at the outlet [220].

The tab [272] that is integral with the breakable seal [270] can have any shape that is suitable for its function. However, it is preferred that the shape of the tab conform to, or complement, the shape of the distal end [211] of the dispensing head [210]. For example, if the distal end of the dispensing head is rounded, then it is preferred that the surface of the tab [272] nearest the dispensing head also be similarly rounded. This feature can be seen, for example, in each of the "A" views of FIGS. 1-13. If desirable, the tab [272] can also be imprinted with instructions or signals that indicate how to break the seal and reveal the outlet. One such signal is an arrow signal indicating a twisting action, as illustrated in each of the "A" views of FIG. 1, and FIGS. 3-13.

It is preferred that the present dispensing container [101] has a top [102] and a bottom [103] and wherein at least a portion of the bottom is flat, thereby permitting the container to rest stably on a flat surface. This feature, which is indicated as [400] in the "D" views of FIG. 1, and FIGS. 3-13, provides that the container can be laid down on a table, or other flat surface, without rolling or tilting. An advantage of this feature is that, if the breakable seal [270] has been broken, the container remains stable and can retain the liquid in the reservoir [201] without spilling.

The squeezable reservoir [201] is a part of the container that is designed to contain some amount of a liquid [301]. In that embodiment of the invention where the reservoir has been pre-filled with the liquid, the squeezable reservoir [201] contains the liquid [301]. The reservoir [201] can be designed to have a volume sufficient to accommodate any amount of the liquid [301] that is desirable. It is preferable that the reservoir is designed to have a volume that is only slightly larger than the amount of the liquid that will be added. In order to simplify the loading of standard dosages of certain liquids, the reservoir can be made to hold a standard volume of liquid. For example, the squeezable reservoir [201] can have a working capacity of about 1 ml of the liquid, or 2 ml, 5 ml, 10 ml, 15 ml, 25 ml, or any other volume of the liquid that is desired. An advantage of this feature is that an accurate amount of a liquid can be pre-filled into the container without any action by the user. This reduces the chance of error in measurement and in dosage administration.

As used herein to describe the reservoir, the term "squeezable" is understood to mean that the reservoir can be deformed or crushed or flattened with a resulting reduction in volume by squeezing between the thumb and finger(s) of one hand. Provided that the breakable seal has been broken and the outlet revealed, the reduction in volume results in expulsion of the liquid contents from the outlet of the device.

In order to improve the gripping characteristics of the dispensing container [101], the squeezable reservoir [201] can have an outer surface having a traction aid thereon [280], whereby the traction aid improves the grip of the container by the user, or the person administering the liquid, if different from the user. The traction aid [280] comprises at least one of ribs, grooves, a roughened area, or a checkered area, or the like. An example of this feature can be seen in the "A", "B", and "C" views of FIG. 1 and FIGS. 3-13, where a section of the outer surface of the top of the squeezable reservoir is shown to have grooves or ridges as a traction aid [280] for gripping the device. The grooves and/or ridges can be substantially straight and perpendicular to the longitudinal axis of the container, or they can be curved, angled, or of any other shape. The present traction aid can be placed on the dispensing container at any location where improved gripping is desirable. For example, this can be on the top, bottom, top and bottom, and/or the sides of the dispensing container.

The traction aid can be can be added to the dispensing container [101] at any time. For example, it may be molded into the device during manufacture, or it may be machined into the surface of the device any time after manufacture. It is preferable, however, that the traction aid be molded integrally into the surface of the device at the time of manufacturing.

One part of the dispensing container [101] is the dispensing head [210] that is integral with the squeezable reservoir [201], and which has a distal end [211] and a proximal end [212]. Typically an outlet [220] is located at the distal end [211] of the dispensing head [210] for dispensing the liquid [301] from the container. The proximal end [212] of the dispensing head [210] abuts the squeezable reservoir [201].

The distal end of the dispensing head [210] can be connected to the reservoir [201] at any location relative to the longitudinal axis of the device [101]. While it has been shown to be preferred that the dispensing head [210] is located at an offset to the longitudinal axis, namely, close to or at the bottom of the device, as is illustrated in the present figures, it could also be located as centered along the longitudinal axis, or near the top of the device, or at any other location relative to the longitudinal axis.

As mentioned above, the dispensing head [210] can have any shape. When the shape of the head is discussed, what is meant is the overall outline of the head as viewed from directly above or below the dispensing container [101], excepting where it interconnects with either the reservoir [201] or the breakable seal [270].

Figure 11A:
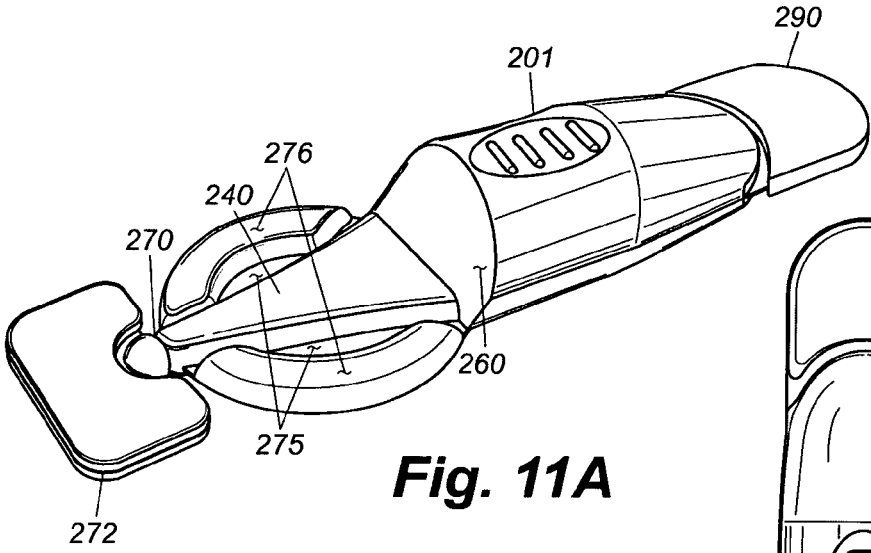
FIG. 11A shows a perspective view.
Figure 11B:
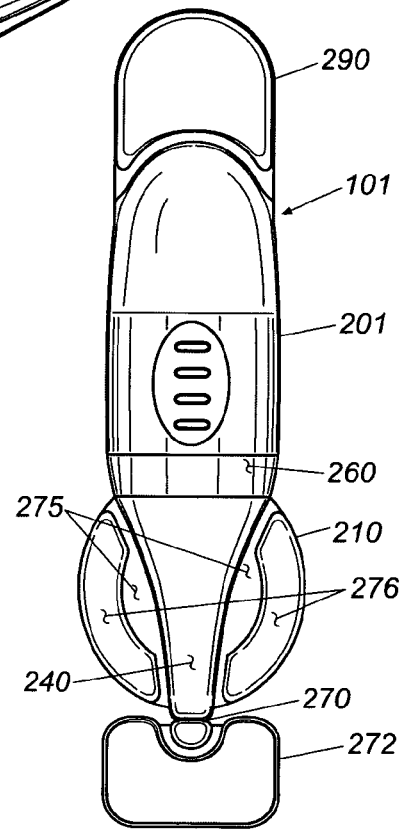
FIG. 11B shows a top elevation view.
Figure 11C:
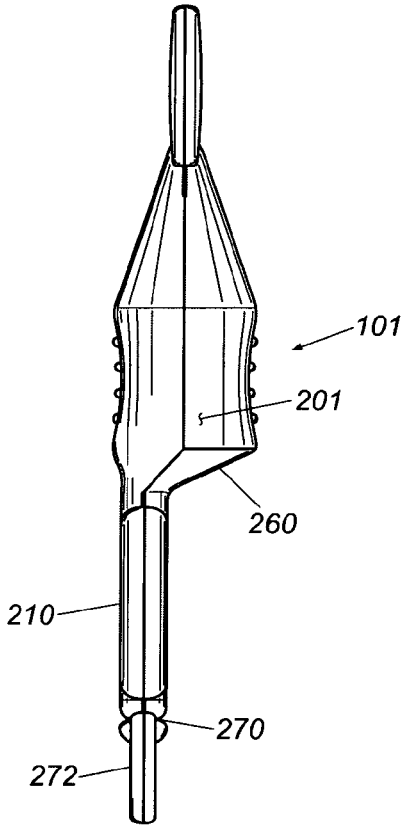
FIG. 11C shows a right side elevation view.
Figure 11D:
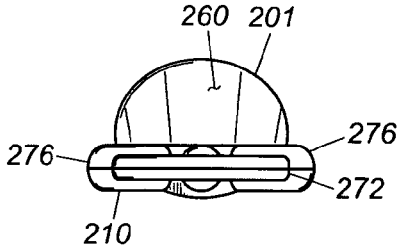
FIG. 11D shows a front end elevation view.

In a preferred embodiment that is especially useful for oral delivery of liquids, the dispensing head is substantially flat. When the dispensing head [210] is described as being substantially flat, it should be understood that the head optionally has some slight degree of curvature and/or rounded edges, as would be introduced during manufacture, or for the purpose of comfortable and safe use. Also, the dispensing head can have certain contours or indentations [275] that are molded into the head [210] during fabrication, such as are shown in FIGS. 11A, and 11B, for example. In a preferred embodiment, the overall aspect of the dispensing head, when viewed from the side, as shown for example in the "B" views of FIGS. 1-13, is that it has a substantially flat profile. In other words, the dispensing head [210] is without the concave profile of a spoon. In certain embodiments, one or both of the top and bottom surfaces of the dispensing head [210] are substantially flat.

When the dispensing head is substantially flat, when viewed from above or below, the head can be optionally round, oval, square, rectangular, triangular, pentagonal, hexagonal, heptagonal, octagonal, or irregular in shape. It is preferred that the dispensing head [210] is round, oval, oblong, or the like, in order to provide comfortable insertion into the mouth of a user.

Figure 12A:
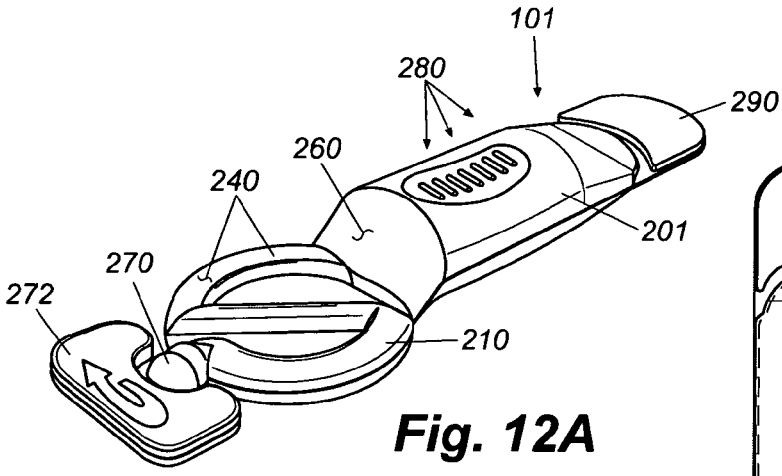
FIG. 12A shows a perspective view.
Figure 12B:
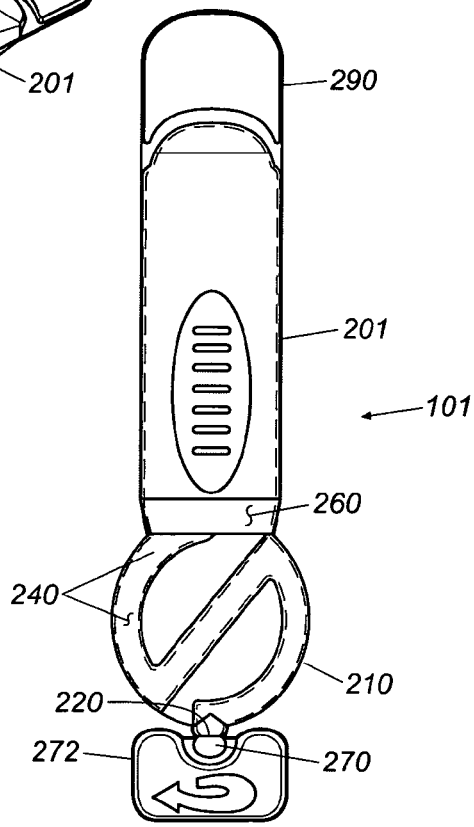
FIG. 12B shows a top elevation view.
Figure 12C:
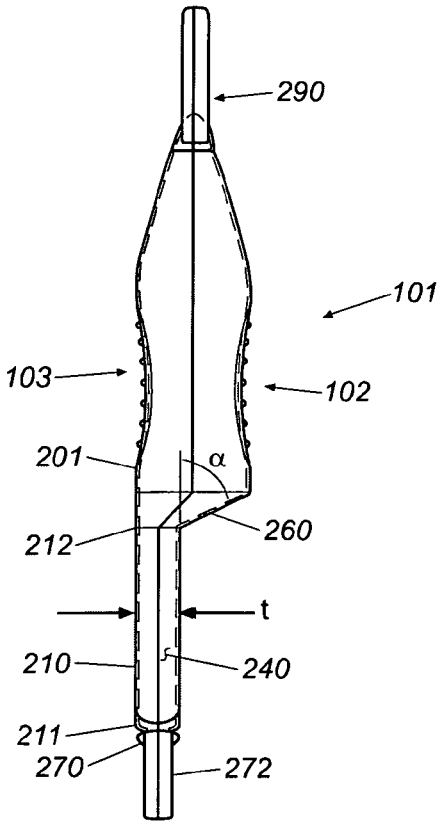
FIG. 12C shows a left side elevation view.
Figure 12D:
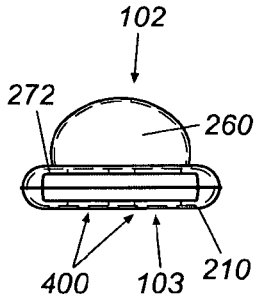
FIG. 12D shows a front end elevation view.
Figure 13A:
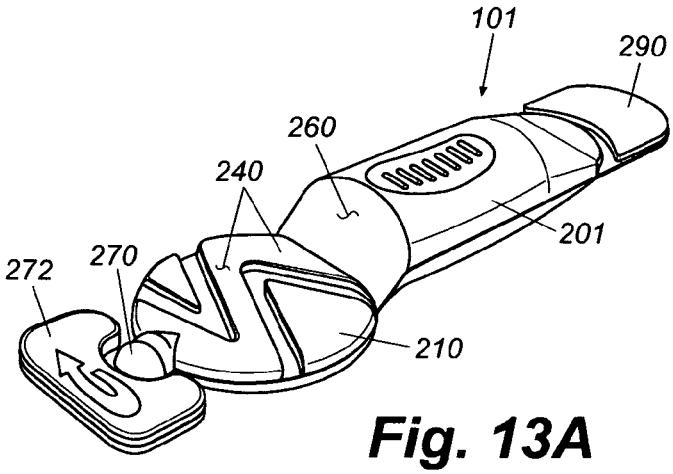
FIG. 13A shows a perspective view.
Figure 13B:
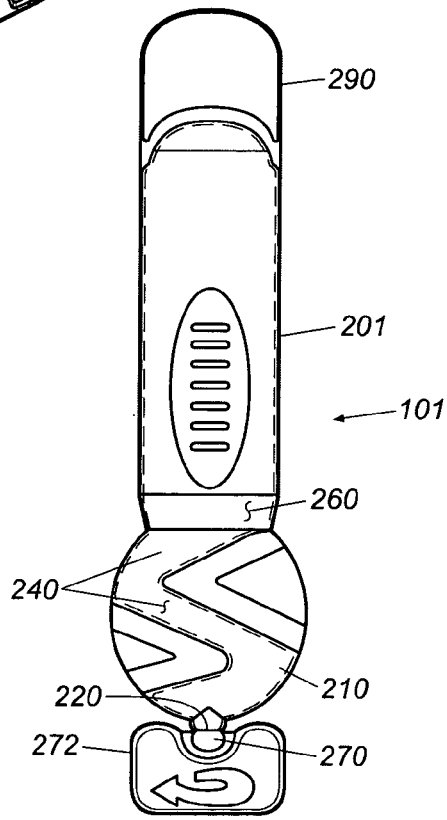
FIG. 13B shows a top elevation view.
Figure 13C:
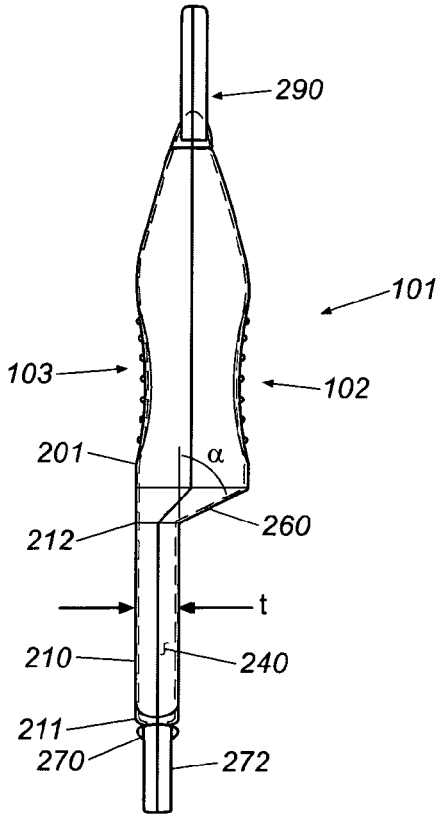
FIG. 13C shows a left side elevation view.
Figure 13D:
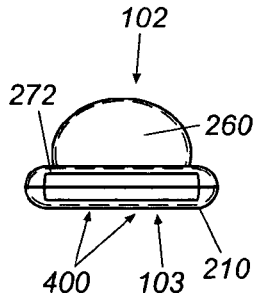
FIG. 13D shows a front end elevation view.

In preferred embodiments, as illustrated in FIGS. 11A, 12A, and 13A, either or both of the top surface of the dispensing head and the bottom surface has an indented portion [275]. When the terms "indented portion" are used herein, they refer to portions of the top surface and/or the bottom surface of the dispensing head that are depressed, or indented, below the plane of the surface as it would appear in profile. For example, an indented portion can be formed in either surface of the dispensing head by a mold projection as the device is formed in a blow-molding operation. The top and the bottom of the dispensing head can have more than one indented portion, and in fact, can have an unlimited number of indented portions.

When the present device is formed by the operation of blow-molding, it is possible to design the mold so that indentations that are formed in the dispensing head are substantially matching. In other words, indentations in the top are of a shape and alignment that substantially match indentations in the bottom, and portions of the top can be sealed to matching portions of the bottom during the blow molding process, thereby forming desired channels and/or shapes in the dispensing head.

In the embodiments shown in FIGS. 11A-13A, the molded contours of the dispensing head result in the formation of flow channels [240]. In these embodiments, matching indented portions [275] in either the top or the bottom, or both, define the shape of the passage [240] that interconnects the squeezable reservoir [201] and the outlet Although only one channel is shown in the device of FIGS. 11A-13A, the number, location, shape, size, and diameter of the channels that are formed in the dispensing head by the molding process can be of almost any design. For example, indentations in the dispensing head can be designed to form one channel or multiple channels, and the channels can be regular or irregular in shape, size, diameter, or the like.

The dispensing head [210] can be of any thickness suitable for its use. The thickness of the dispensing head [210] is illustrated, for example, as the dimension "t" in the "C" views of FIG. 1 and FIGS. 3-13. When the dispensing head is substantially flat, it is preferred that the dispensing head is from about 0.5 mm to about 20 mm thick. In some embodiments, the dispensing head may be from about 0.5 mm to about 10 mm thick and sometimes from about 2 mm to about 6 mm thick. In an even more preferred embodiment, the dispensing head may be about 5 mm thick. The actual thickness of the dispensing head will depend on several factors, including the age and mouth size of the subject to which the liquid is being dispensed and various manufacturing tolerances and issues.

A passage [240] interconnects the squeezable reservoir [201] and the outlet [220]. The purpose of the passage [240] is to provide a path whereby the liquid [301] in the reservoir [201] can be delivered to the outlet [220] at the distal end [211] of the dispensing head [210]. The passage can be of any shape or size suitable to deliver the liquid to the outlet.

The outlet [220] is revealed when the breakable seal [270] is broken and removed from its initial position covering the outlet and sealing the container. The outlet can have any shape. For example, the outlet can be oval, rectangular, square, circular, or any other shape. Furthermore, the device can have two or more outlets. It is preferred, however, that the outlet is substantially circular in shape.

An advantage of location of the outlet [220] at the distal end of the dispensing head is that this location insures that the liquid contents of the container are delivered deep into the mouth, or other cavity, of the user, thereby preventing or reducing the rejection or spillage of the liquid as can occur if it is presented in the bowl of a spoon.

It is preferred that the outlet has a diameter that is small enough so that the surface tension of the liquid and its affinity for the polymer of which the device is constructed is sufficient to prevent leakage or dripping of the liquid from the outlet when the breakable seal is removed and when no squeezing pressure is being applied to the reservoir. When the liquid has the properties of water and the device is made from polyethylene, for example, it is preferred that the outlet has a diameter that is no larger than about 2.5 mm in order to ensure that no leakage occurs. As would be expected, changes in surface tension properties and in affinity between the liquid and the polymer from which the device is constructed will cause the maximum allowable outlet diameter to vary somewhat. Typically, the outlet diameter is between about 1 mm and 3 mm, preferably between about 1.2 mm and about 2.8 mm, and more preferably between about 1.6 mm and about 2.2 mm.

As mentioned above, it is desirable to control the flow of liquid from the outlet during administration to a user so that the liquid is effectively delivered to the user with minimal loss and with minimal discomfort. In the case where liquid is being delivered to a user orally, and in particular when the user is a child or infant, the inventors have found that it is desirable to control the outlet velocity of the liquid and the delivery time, as those terms are defined herein. Moreover, the inventors believe that the outlet velocity and delivery time parameters that have been found to be useful for oral delivery of liquids, are also effective for the delivery of liquids to the ear, eye, and any other physiological location. It has been found that an outlet velocity between about 1 m/s and about 20 m/s is preferred, between about 2 m/s and about 15 m/s is more preferred, between about 3 m/s and about 10 m/s is yet more preferred, and between about 3 m/s and about 8 m/s is even more preferred.

It has also been found that a delivery time of between about 0.5 sec and about 7 sec is preferred, between about 0.7 sec and about 5 sec is more preferred, and between about 1 sec and about 3 sec is even more preferred.

When the preferred values for the outlet velocity and the diameter of the outlet are considered, it is found that the preferred flow rate of liquid from the outlet during squeezing ranges between about 1 ml/sec and about 50 ml/sec, and is more preferably between about 6 ml/sec and about 30 ml/sec.

Because the liquid contents of the present device are delivered due to squeezing—normally between the thumb and forefinger of an adult —the inventors found it necessary to determine the squeezing force that a normal adult would impart to the device. In the General Procedures section, discussed below, it was determined that the normal squeezing pressure exerted by a typical adult on a device shaped like the present dispensing container was about 10 lbf, and that this force resulted in a pressure at the inlet of the passage of about 57 mm-$H_2O$. Given these values, the present flow control system can be designed to provide the desired outlet velocity and delivery time, while preventing dripping or leakage when pressure is not being applied.

In the flow-control system of the present invention, the passage [240] and the outlet [220] can be designed in a manner that controls the rate of flow of the liquid [301] from the reservoir [201], when the dispensing container is squeezed by the user. In addition, an inlet [230] can be formed between the reservoir [201] and the passage [240], so that it also can become an element in the flow-control system. Examples of several embodiments of dispensing containers having the present flow-control system are illustrated in FIGS. 1A-13D. In each embodiment, the shape, cross-sectional flow area, length, and internal wall roughness of the inlet [230], passage [240] and outlet [220] of the present flow-control system is designed to provide a resistance to the flow of the fluid [301], such that when a normal squeezing pressure is applied to the reservoir [201], the velocity of flow of the liquid from the outlet [220] is at a desired value.

For a flow control system having a single channel, the desired diameter of the passage ($D_{ch}$) can be calculated as follows. The velocity at inlet [230] and the velocity at outlet [220] are related by the continuity equation.

$$A_{in} v_{in} = A_{out} v_{out}$$

The pressure drop between the inlet and the outlet is ($P_{in}$-$P_{out}$. Where $P_{in}$ is the gage pressure produced by squeezing the reservoir [201] and $P_{out}$ is generally considered to be atmospheric pressure. The inlet pressure has to be greater than the outlet pressure ($P_{in}>P_{out}$) for fluid to move from the reservoir [201] and exit the outlet [220]. The pressure drop through the flow control system (inlet, passage, and outlet) is found using FIG. 15 for a given squeeze force. Knowing the internal pressure of the reservoir body [201] when it is being squeezed and knowing the outlet pressure to atmosphere, a pressure drop across the flow control system ($\Delta P$) is found. The fluid properties; namely, the absolute viscosity ($\mu$) ($\mu_{water}$=1 centipoise) and density ($\rho$) ($\rho_{water}\approx 1000$ kg/m$^3$ at 20° C.) need to be known. Using these parameters and assuming a reasonable value for the average velocity of liquid through the passage ($v_{avg}$), one can calculate the Reynolds number of the fluid (Re), as:

$$Re = \frac{\rho v_{avg} D_{ch}}{\mu}$$

Reynolds numbers less than 2000 indicate laminar flow, and greater than 2000 indicate turbulent flow. The Reynolds number can then be used in the Blasius formula to find the friction factor as;

$$f = \frac{0.316}{Re^{1/4}}$$

This formula is valid for Reynolds numbers up to 100,000 which is expected to be the case for all anticipated applications of the present invention. Next, a new average velocity of the channel is calculated using a form of the Darcy equation (also known as the Weisbach equation or Darcy-Weisbach equation) which is valid for both laminar and turbulent flow, as follows:

$$V_{avg} = \left(\frac{2\Delta P D_{ch}}{fL\rho}\right)^{1/2}$$

With this value, a new corresponding value for the Reynolds number is calculated along with a new friction factor. After a brief iterative process (no more than a few cycles) the average velocity converges to a single value. This value of velocity is the predicted average channel [240] velocity, and it can be substituted into the continuity equation to find the predicted outlet velocity, as:

$$V_{out} = \left(\frac{D_{ch}}{D_{out}}\right)^2 V_{avg}$$

As discussed above, tests indicate that a preferred target outlet velocity for oral use falls between about 3 m/s and about 8 m/s. Therefore, if the outlet velocity is higher or lower than the desired range, then the channel diameter can be changed to provide an outlet velocity that falls within the desired range. Also, when the fluid properties of the dispensing liquid change, the above analysis can be used to determine the physical parameters of the flow control system.

Several different embodiments of the present flow control system are illustrated in the figures that accompany this application. For example, FIG. 1 illustrates an embodiment of the present flow-controlled dispensing container having a disk-shaped central passage. FIG. 3 illustrates an embodiment of the present flow-controlled dispensing container in which the passage is a single cylindrical channel of varying internal diameter, where variation in channel diameter can be used as a variable to control pressure drop and, therefore, flow rate. FIG. 4 illustrates an embodiment of the present flow-controlled dispensing container having a single square-ended zig-zag passage, and FIG. 5 illustrates an embodiment of the present flow-controlled dispensing container having a passage comprising multiple irregular channels that meet at a single inlet and a single outlet. FIG. 6 illustrates an embodiment of the present flow-controlled dispensing container having a passage having an inlet with a different cross-section area than the outlet. FIG. 7 illustrates an embodiment of the present flow-controlled dispensing container having a passage with a single inlet that splits into multiple channels, each channel having its own separate outlet, and FIG. 8 illustrates an embodiment of the present flow-controlled dispensing container having an irregularly shaped single channel passage. FIG. 9 illustrates an embodiment of the present flow-controlled dispensing container having a serpentine passage. FIG. 10 illustrates an embodiment of the present flow-controlled dispensing container having split circumferential passages, in which the liquid flows around the sides of the dispensing head. FIG. 11 illustrates an embodiment of the present flow-controlled dispensing container having a central passage defined by indentations in the top and bottom of the dispensing head. FIG. 12 illustrates an embodiment of the present flow-controlled dispensing container having a passage that is roughly in the shape of an "S" and which is formed by indentations in the top and bottom of the dispensing head, and FIG. 13 illustrates an embodiment of the present flow-controlled dispensing container having a passage that is roughly in the shape of a "Z" that is formed by indentations in the dispensing head.

A feature of the present dispensing container is a stop [260], which is disposed near the proximal end [212] of the dispensing head [210]. The stop prevents over-insertion of the dispensing head into a user's mouth or other bodily orifice. As used herein, the term "over-insertion" means the insertion of a device, for example, into the mouth of a user to a depth that causes choking, or blockage of oral air or throat passages. In one embodiment, the stop [260] is located at the proximal end [212] of the dispensing head [210] and extends outwardly from a flat surface of the dispensing head at an acute angle of from about 30° to about 90° from the plane of the dispensing head. In a preferred embodiment, the stop extends outwardly from a flat surface of the dispensing head at an angle of about 60° from the plane of the dispensing head. This is illustrated, for example, in the "C" views of FIG. 1 and FIGS. 3-13, where the angle "α" denotes the angle between the plane of the flat surface of the dispensing head [210] and the stop [260].

The purpose of the stop [260] is to arrest the penetration of the dispensing head into the mouth of the user. Therefore it is desirable that the stop be large enough to accomplish this task. Because this feature is particular advantageous when the user is an infant, it is preferred that the stop extends outwardly from a flat surface of the dispensing head a distance sufficient to prevent or retard the continued insertion of the dispensing container into the mouth of an infant past the stop.

In one embodiment of the present dispensing container [101], the stop is a portion of the outer surface of the reservoir [201]. This is illustrated, for example, in the "A" views of FIG. 1 and FIGS. 3-13, where the stop [260] is shown as the outside surface of the front wall of the squeezable reservoir [201]. If desirable, the front wall of the reservoir can be made to be slightly thicker than other walls of the reservoir in order to retain its shape and function during use.

The present dispensing container [101] can also be made to have a tail [290]. The tail can be of any shape, but is typically substantially flat and is disposed from the reservoir [201] at a location that is opposite the dispensing head [210] and in a plane that is substantially parallel to the plane of the dispensing head. This position of the tail [290] is illustrated, for example, in the "A" views of FIG. 1 and FIGS. 3-13. A useful feature of the tail is that it increases the gripping surface of the dispensing container [101], and, optionally, it can be used to display information relating to some characteristic of the dispensing container or its contents. By way of example, such information can include the volume of the liquid contained in the reservoir, the date of manufacture of the liquid, the date of filing the container, the date of recommended use for the liquid, the expiration date for the liquid, the chemical name of the liquid, the catalog or lot number of the liquid, or the common name of the liquid, or the like.

Also within the scope of the present invention is a pre-filled dispensing container having a liquid therein. The container comprises a squeezable reservoir that contains the liquid; a substantially flat dispensing head which is integral with the squeezable reservoir and having a distal end and a proximal end; an outlet at the distal end of the dispensing head for dispensing the liquid from the container; a passage interconnecting the squeezable reservoir and the outlet; a stop disposed near the proximal end of the dispensing head to prevent over-insertion of the dispensing head into a user's mouth when the container is used to dispense liquid to the user; and a flow control system which limits the rate of flow of liquid from the outlet when the dispensing container is squeezed.

Figure 2A:
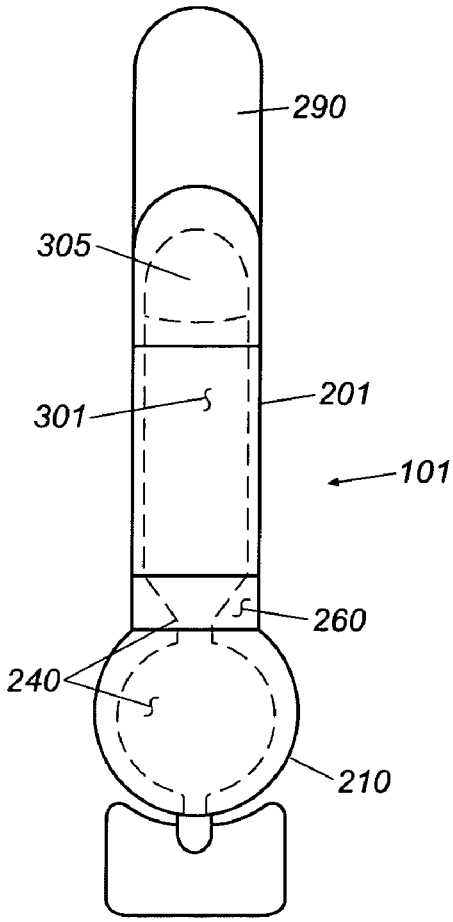
FIG. 2A shows a top elevation view.
Figure 2B:
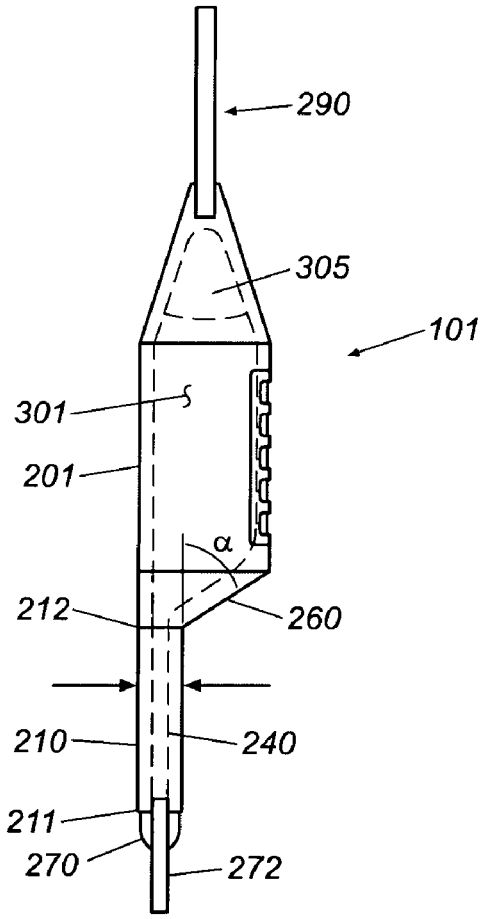
FIG. 2B shows a left side elevation view, with both views illustrating liquid in the reservoir and a headspace.
Figure 3A:
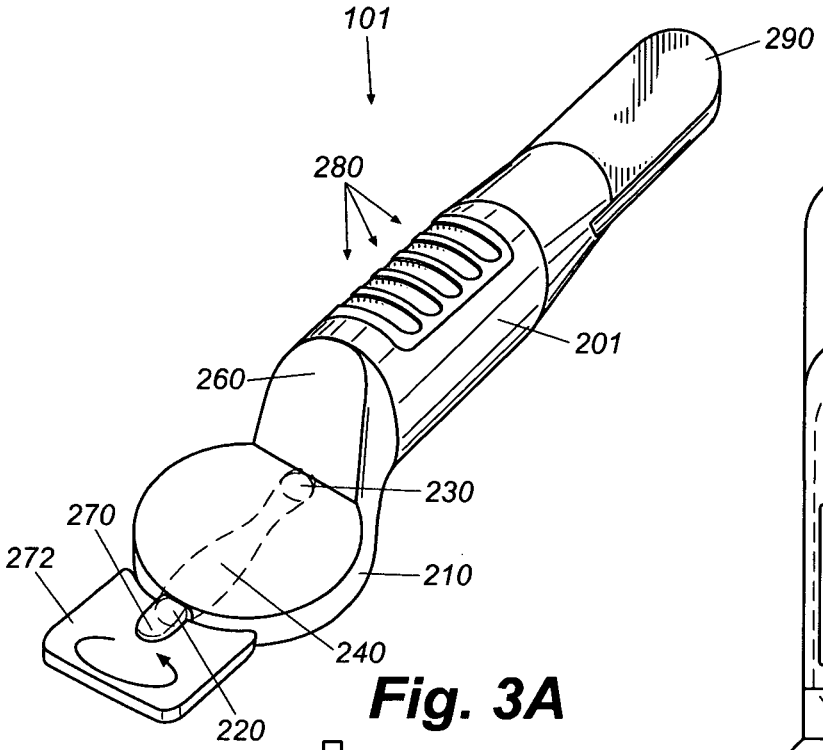
FIG. 3A shows a perspective view.
Figure 3B:
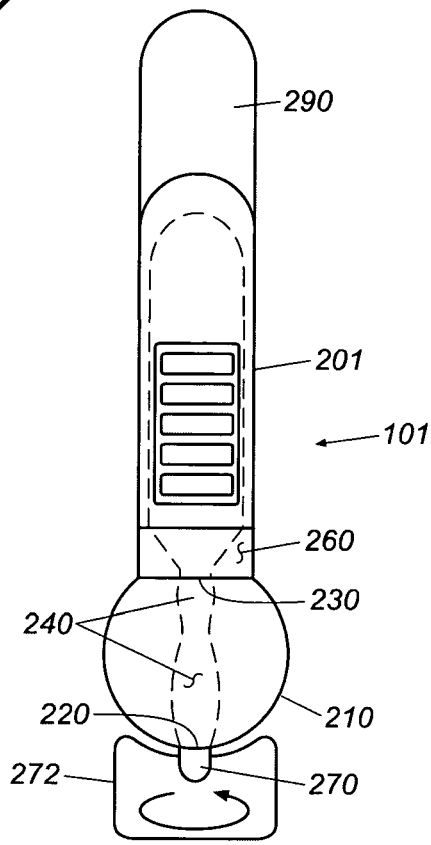
FIG. 3B shows a top elevation view.
Figure 3C:
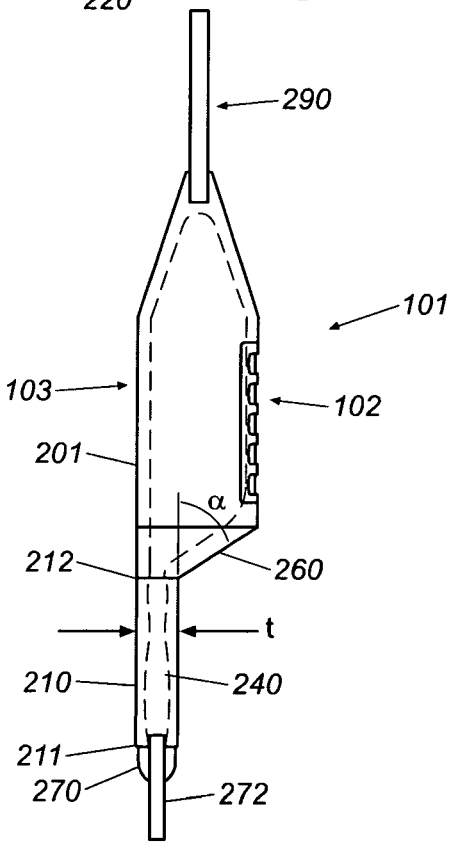
FIG. 3C shows a left side elevation view.
Figure 3D:
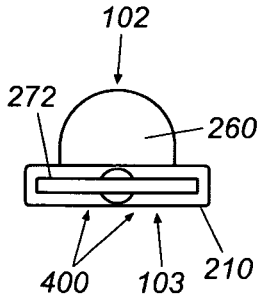
FIG. 3D shows a front end elevation view.
Figure 4A:
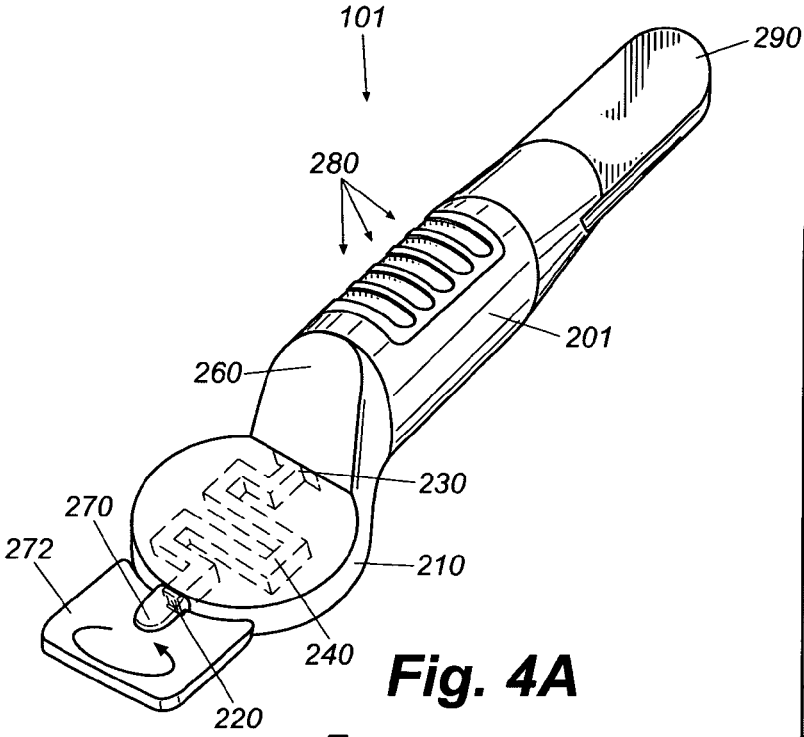
FIG. 4A shows a perspective view.
Figure 4B:
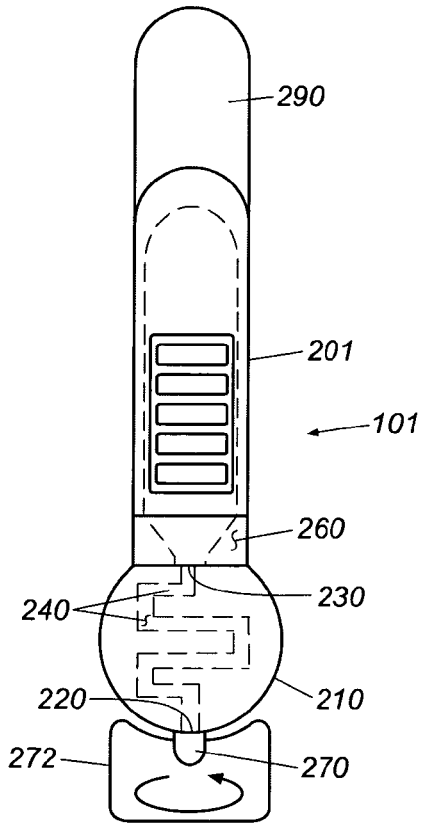
FIG. 4B shows a top elevation view.
Figure 4C:
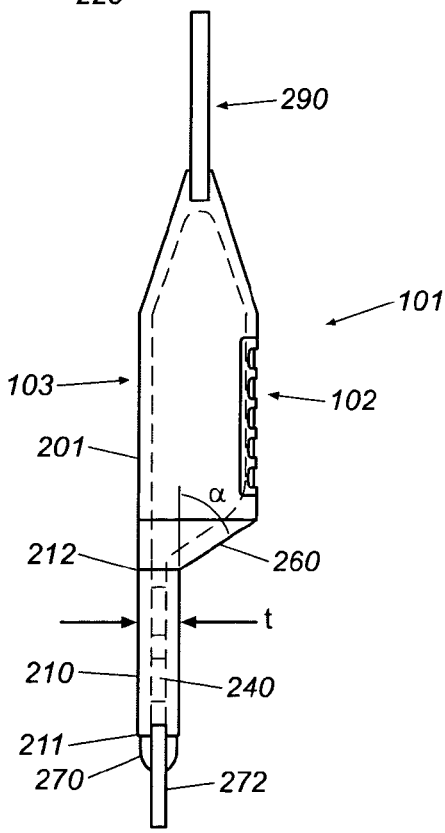
FIG. 4C shows a left side elevation view.
Figure 4D:
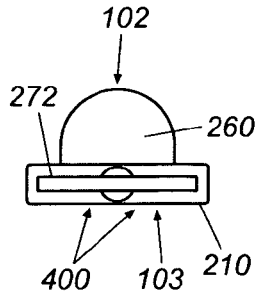
FIG. 4D shows a front end elevation view.
Figure 5A:
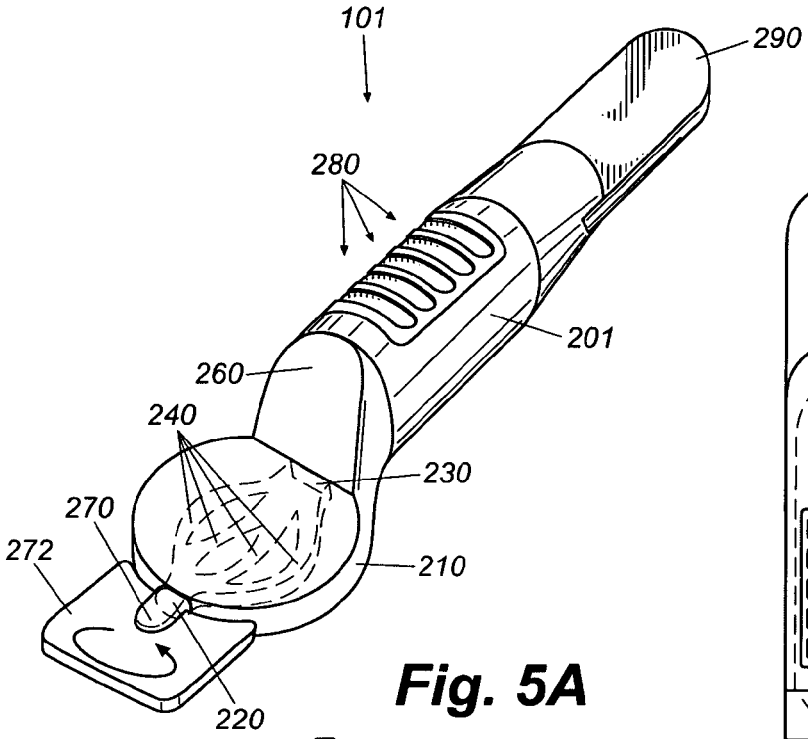
FIG. 5A shows a perspective view.
Figure 5B:
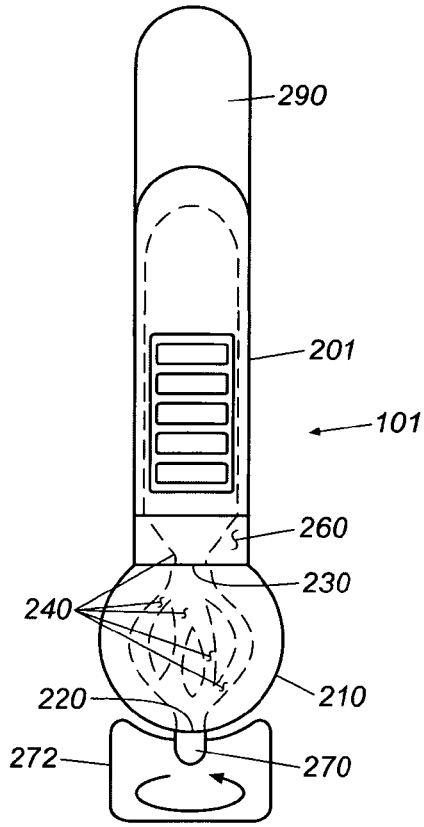
FIG. 5B shows a top elevation view.
Figure 5C:
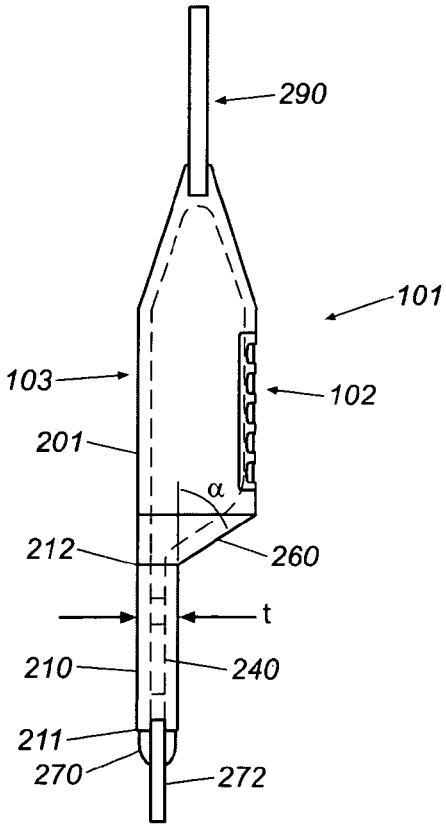
FIG. 5C shows a left side elevation view.
Figure 5D:
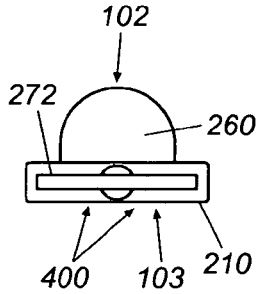
FIG. 5D shows a front end elevation view.
Figure 6A:
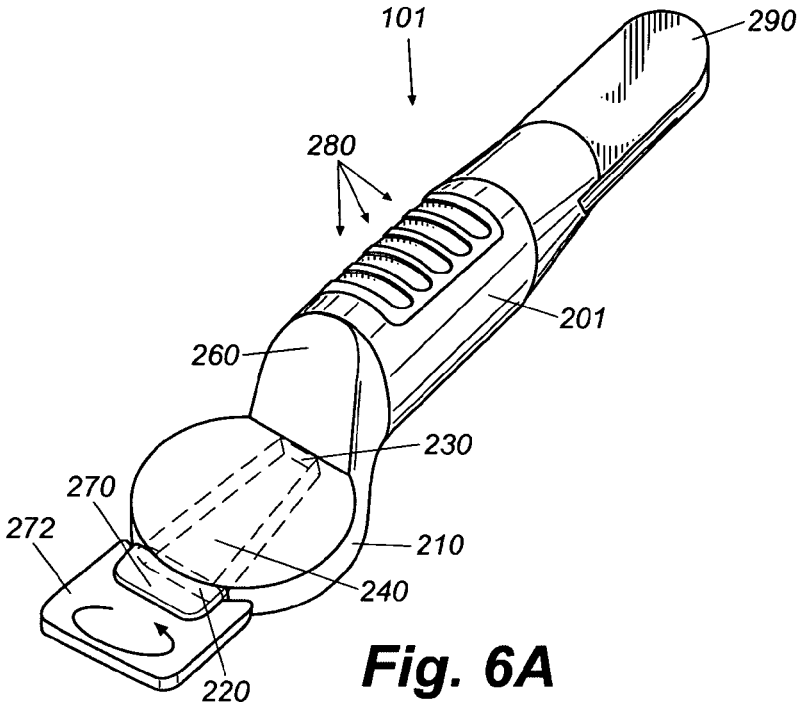
FIG. 6A shows a perspective view.
Figure 6B:
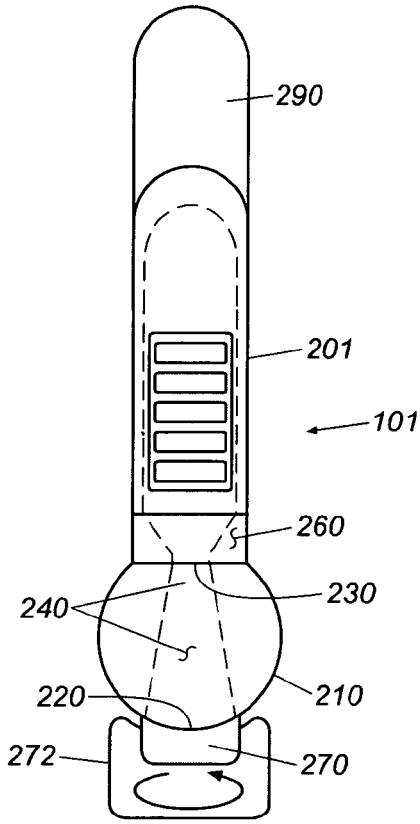
FIG. 6B shows a top elevation view.
Figure 6C:
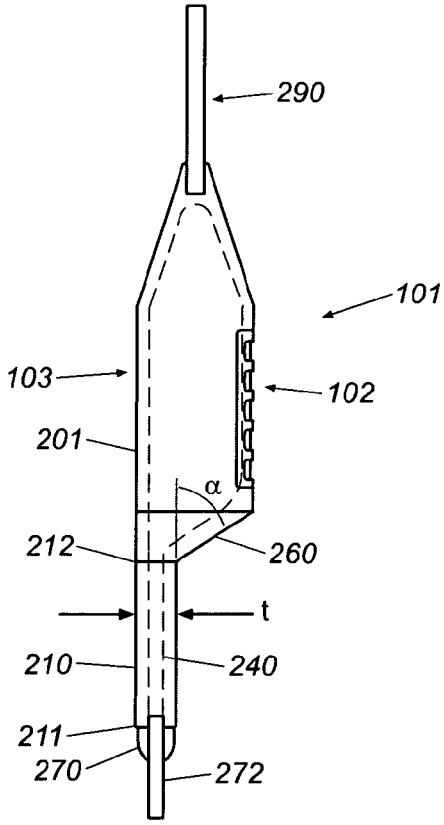
FIG. 6C shows a left side elevation view.
Figure 6D:
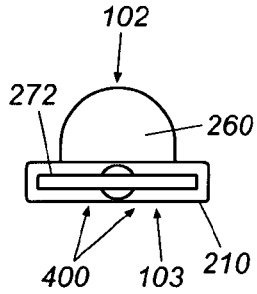
FIG. 6D shows a front end elevation view.
Figure 7A:
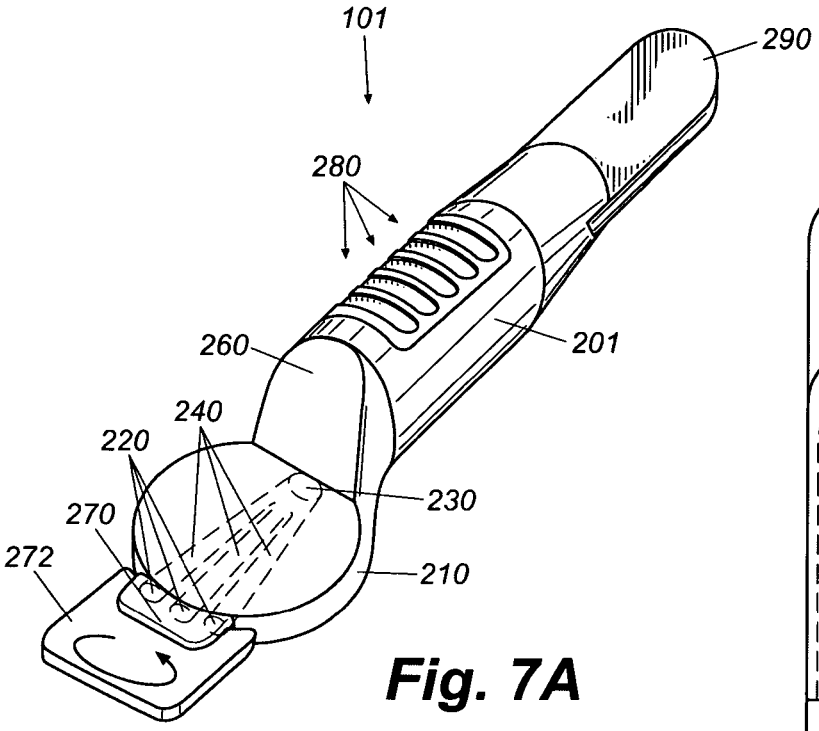
FIG. 7A shows a perspective view.
Figure 7B:
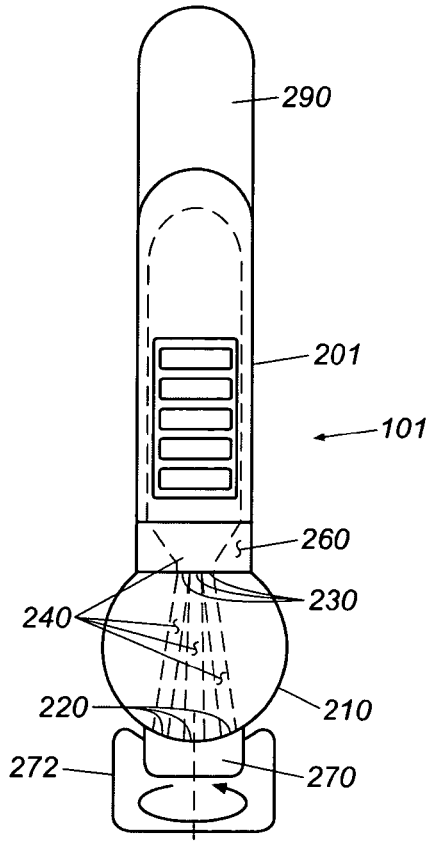
FIG. 7B shows a top elevation view.
Figure 7C:
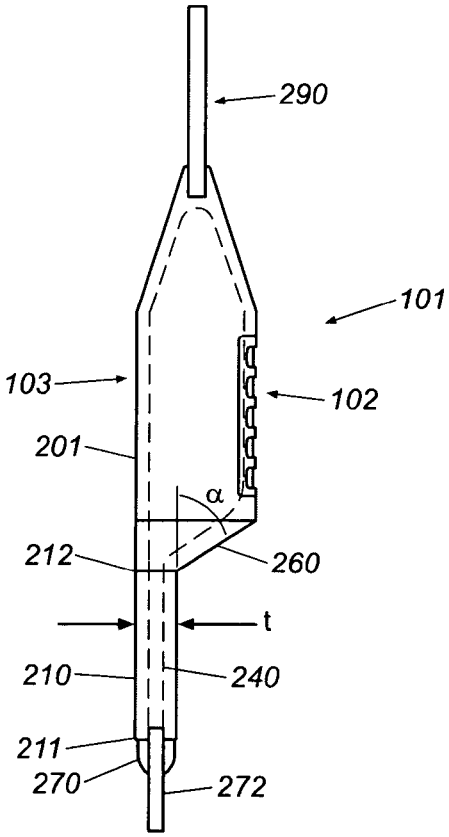
FIG. 7C shows a left side elevation view.
Figure 7D:
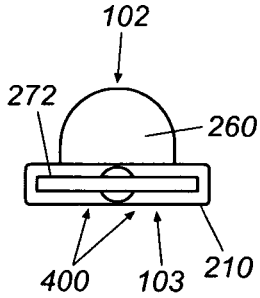
FIG. 7D shows a front end elevation view.
Figure 8A:
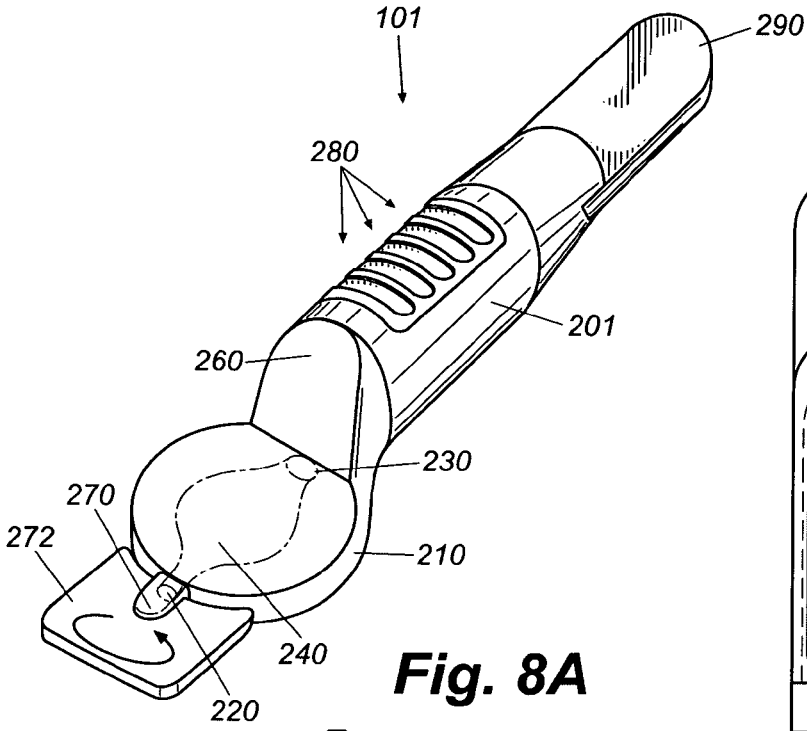
FIG. 8A shows a perspective view.
Figure 8B:
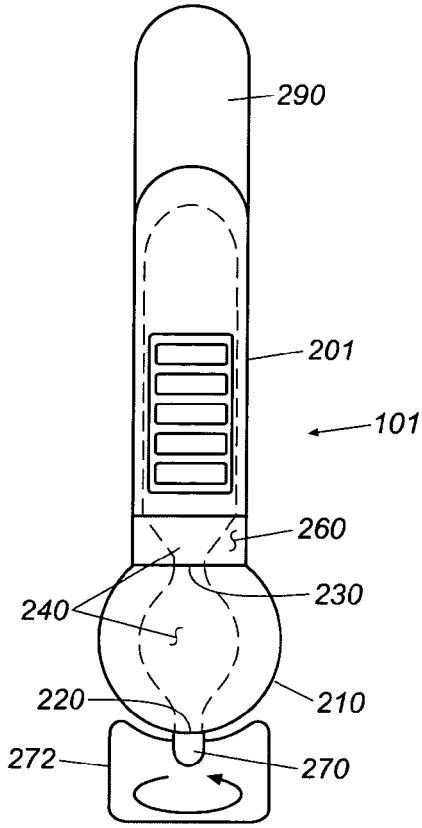
FIG. 8B shows a top elevation view.
Figure 8C:
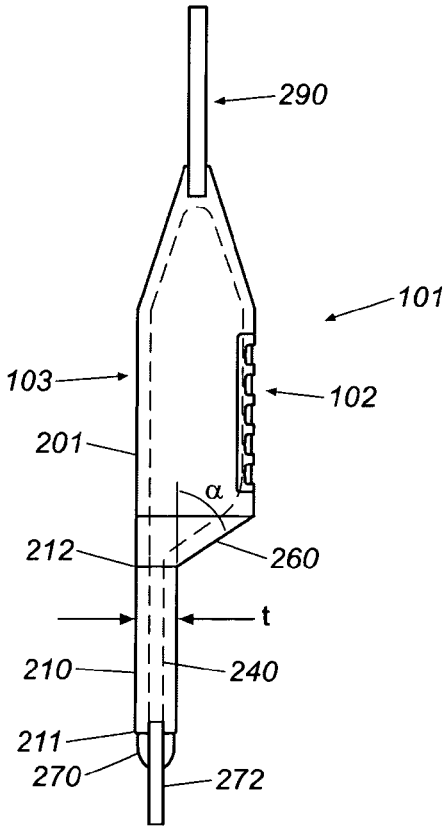
FIG. 8C shows a left side elevation view.
Figure 8D:
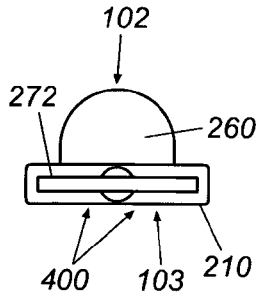
FIG. 8D shows a front end elevation view.
Figure 9A:
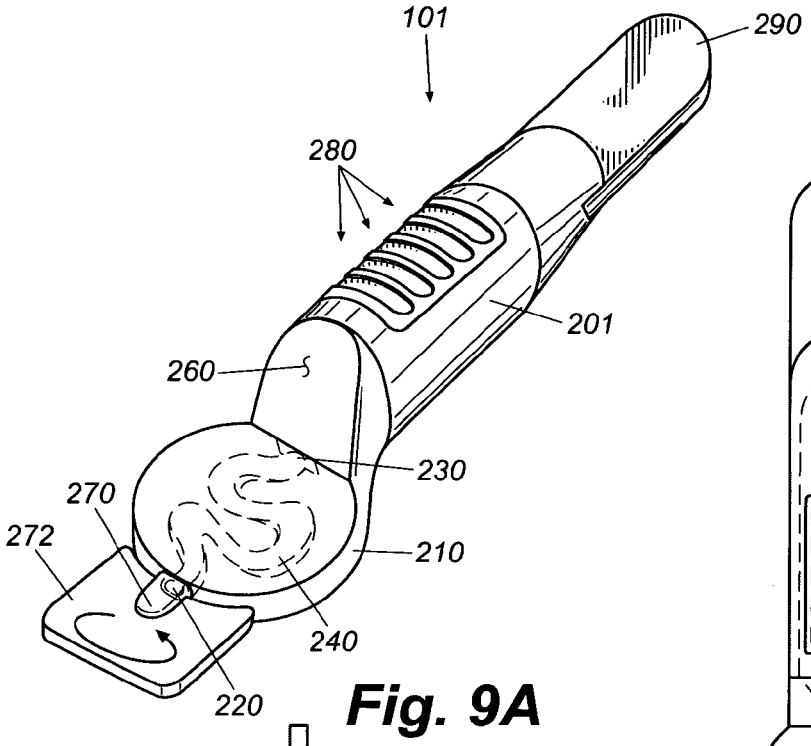
FIG. 9A shows a perspective view.
Figure 9B:
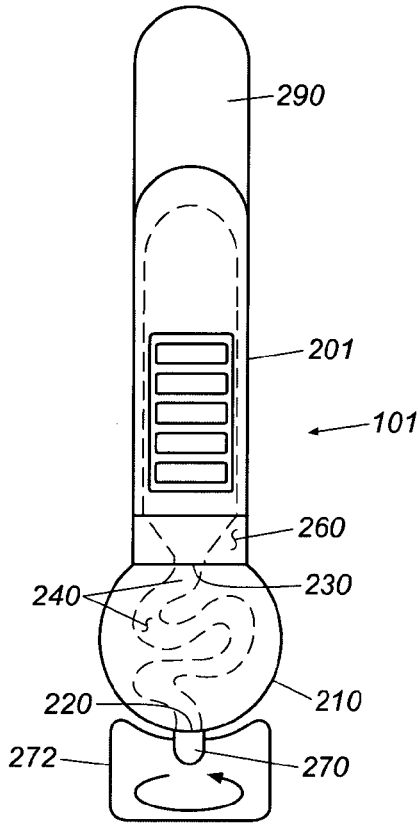
FIG. 9B shows a top elevation view.
Figure 9C:
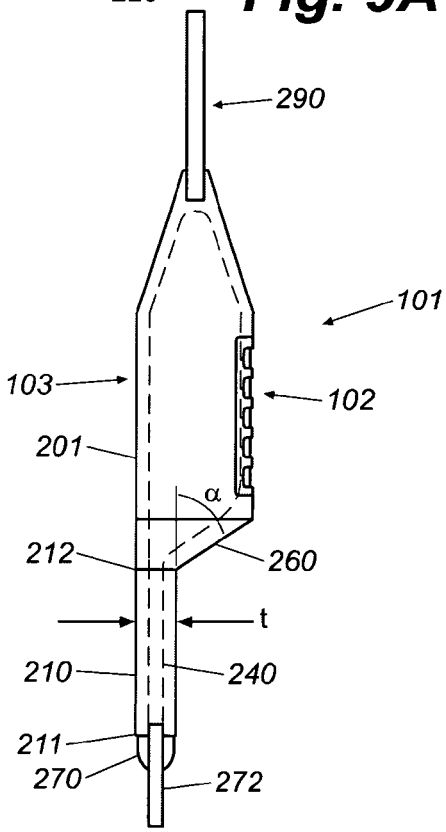
FIG. 9C shows a left side elevation view.
Figure 9D:
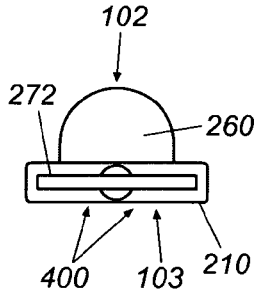
FIG. 9D shows a front end elevation view.
Figure 10A:
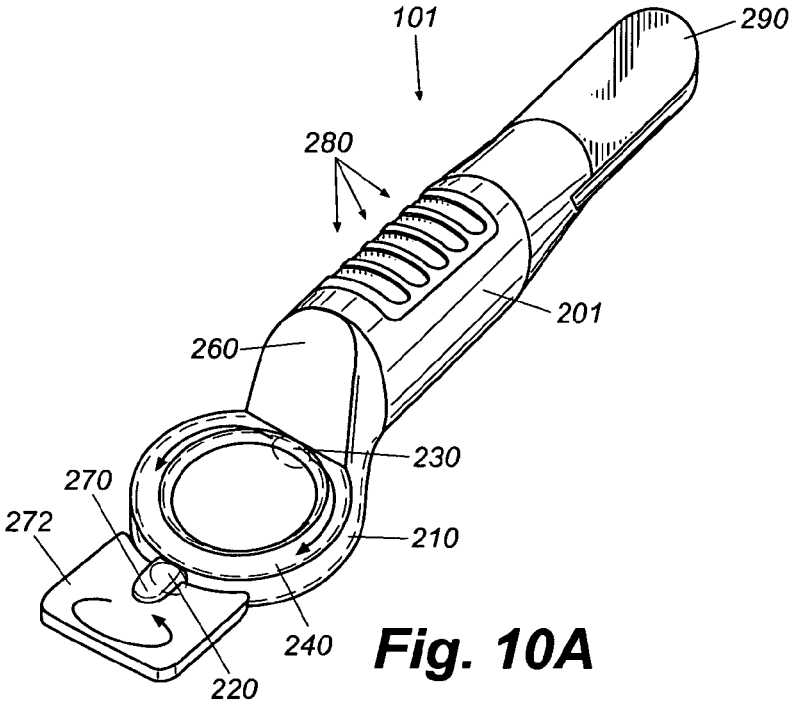
FIG. 10A shows a perspective view.
Figure 10B:
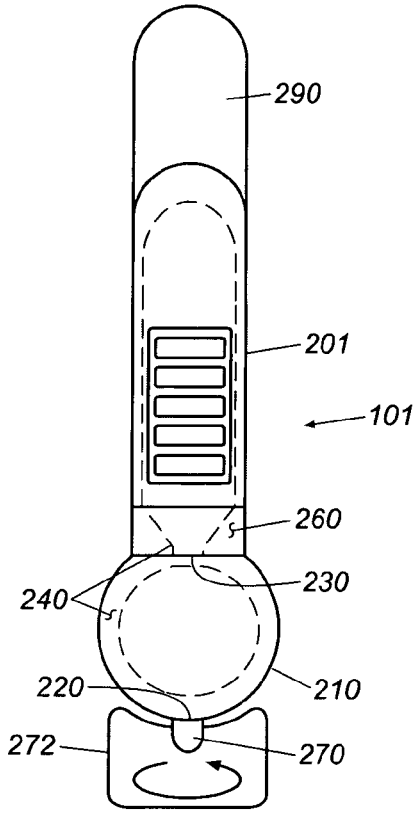
FIG. 10B shows a top elevation view.
Figure 10C:
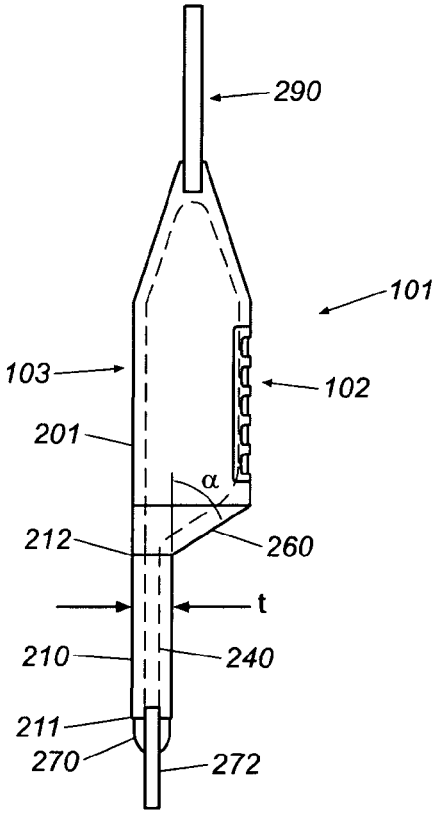
FIG. 10C shows a left side elevation view.
Figure 10D:
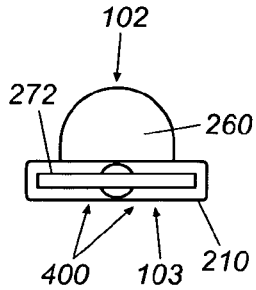
FIG. 10D shows a front end elevation view.

FIGS. 2A and 2B, illustrate several features of an embodiment of a pre-filled dispensing container. For example, these figures illustrate the dispensing container [101] having a liquid [301] in the squeezable reservoir [201].

The present device can be used to contain and dispense almost any liquid that is suitable for administration to a user. As the term "liquid", is used herein, it should be understood to include a clear liquid, a paste, suspension, emulsion, microemulsion, or any other material having the general flow characteristics of a liquid. It is preferred that the viscosity of the liquid is from about 0.05 to about 1,000,000 centipoise at room temperature. Viscosities may also range from about 0.5 to about 20,000 centipoise and from about 1.0 to about 10,000 centipoise, with a viscosity of from about 1.0 to about 1,000 centipoise being even more preferable.

The present dispensing container is useful for administering a liquid to a user. In particular, it is useful for delivering a measured amount of a liquid to the mouth, ear, eye, nose, or other bodily orifice of a user. As mentioned above, this characteristic is desirable when administering liquids to users where the amount of the liquid that is delivered to the user is important, such as, for example, the administration of drugs, neutraceuticals, vitamins, or medicines. In a preferred embodiment, the liquid [301] is selected from vitamins, over-the-counter drugs, or prescription drugs.

When the liquid [301] is added to the squeezable reservoir [201] of the present device, it is sometimes desirable, although not required, that the reservoir also contain a gas in the head-space of the reservoir. In some embodiments, it is desirable to control the type of gas that is added, such as, for example, when it is desirable to have an inert gas in the head-space. This can be done by controlling the type of gas that is added to the head-space, and/or the pressure of the head-space gas. In FIG. 2A and FIG. 2B, the head-space gas is illustrated as [305].

Although the head-space gas [305], if one is used, can be almost any gas, it is preferred that the head-space gas comprises air, sterile air, oxygen gas, nitrogen gas, other inert gas, or a mixture thereof. In like manner, although the head-space gas can be included in the reservoir at almost any pressure which the reservoir will withstand, it is preferred that the head-space gas in the reservoir is at a pressure of from 0 to about 3 bar gauge, with a pressure of from about 0 to about 1 bar gauge being more preferred. In some embodiments, a vacuum may be present in the head-space so that the pressure is actually less than 0 bar gauge. However, most embodiments of the present invention will have atmospheric pressure (e.g., 0 bar gauge) in any head-space. The exact pressure employed may vary depending on the viscosity of the liquid being used.

The present dispensing container can be made by any method. However, it has been found that a preferred method for manufacturing the device is by blow-fill-seal technology. Information about blow-fill-seal technology can be found, for example, in *Blow-Fill-Seal Technology*, R. Oschmann et al., CRC Press, Boca Raton, Fla. (1999), or in *Blow-Fill-Seal—Advanced Aseptic Processing*, D. Jones, published in *Encyclopedia of Pharmaceutical Technology*, $2^{nd}$ Ed., Marcel Dekker, Inc., New York, N.Y. (2002). Blow-fill-seal systems and equipment are available from several manufacturers, such as rommelag® USA, Inc., Edison, N.J.

The present invention is also directed to a novel method of making a pre-filled dispensing container having a liquid therein, the method comprising: extruding a polymer into a blow mold; closing the mold; forming a dispensing container comprising a squeezable reservoir designed to contain the liquid, a substantially flat dispensing head which is integral with the squeezable reservoir and having a distal end and a proximal end, an outlet at the distal end of the dispensing head for dispensing liquid from the container, a passage interconnecting the squeezable reservoir and the outlet, a stop disposed near the proximal end of the dispensing head to prevent over-insertion of the dispensing head into a user's mouth when the container is used to dispense liquid to the user, and a flow control system which limits the rate of flow of liquid from the outlet when the dispensing container is squeezed; adding the liquid to the dispensing container; sealing the outlet with a breakable seal; and removing the sealed pre-filled dispensing container from the mold.

Almost any thermoplastic or thermoset polymer can be used for the production of the present dispensing container. However, it is preferred that the polymer is one that can be extruded. Examples of polymers that are useful for the production of the present invention include, without limitation, polyethylene, polypropylene, ethyl vinyl alcohol copolymer, cyclic olefin copolymer, cyclic olefin polymer, liquid crystal polymer, polyethylene terephthalate, anhydride modified polyolefin, polycarbonate, polyacrylic, polyacrylonitrile, polyvinylchloride, polystyrene, a fluoropolymer, a thermoplastic polyester, nylon, or a mixture of any of these.

Examples of polymers that are preferred for use in the present device include low-density polyethylene, high-density polyethylene, linear low density polyethylene, medium density polyethylene, oriented polyethylene terephthalate, polyethylene terephthalate copolymer, anhydride modified ethylene vinyl acetate, anhydride modified low density polyethylene, anhydride modified linear low density polyethylene, polybutylene terephthalate, crystalline nylon, amorphous nylon, MXD6, or mixtures thereof. It is more preferred that the polymer from which the present device is made is low-density polyethylene, high-density polyethylene, medium density polyethylene, or polypropylene.

Polymers that are useful for the production of the present container can also be intermixed with any type of additive that is typically used in polymer processing and which does not interact undesirably with the liquid. Additives such as: UV stabilizers, thermal stabilizers, processing aids, nucleating agents, clarifiers, and antistatic agents may be added to the resins above during the production of the container at any percent loading.

Polymers that are useful for the production of the present device can be characterized by their melt index. As used herein, the terms "melt index" mean the number of grams of a polymer that can be forced through a 0.0825 inch orifice in 10 minutes at 190° C. by a pressure exerted by a mass of 2160 g (43.25 psi). In preferred embodiments, the polymer has a melt index between about 0.1 and 200 g/10 min and more preferred is a polymer having a melt index between about 0.1 to about 20 g/10 min. The melt index will depend on the particular polymer chosen in order to provide the container with the desired characteristics for its operating environment to allow successful transfer of any liquid contained therein.

In some embodiments of the present dispensing container, it is preferred that the polymer is sufficiently transparent or translucent that the amount or condition of liquid in the reservoir can be determined visually. This is particularly useful to determine whether the full amount of the contents of the reservoir have been expelled when the device is used. Also, this feature is useful when the visible features of the liquid indicate some characteristic, such as, for example, when cloudiness of the liquid could indicate contamination, or excess aging, or the like.

In other embodiments, it is preferred that the reservoir of the dispensing container have walls that block light.

In some embodiments of the pre-filled dispensing container, the dispensing container can be color-coded to identify a property of the liquid in the reservoir. This is particularly useful when it is desirable to provide a clear and easily understood signal of some characteristic of the device or its contents. For example, a red container could signify contents requiring particular care in use, or the like. A blue container could indicate liquid contents requiring refrigeration, or the like.

In a preferred method, the polymer is extruded into the blow mold in the form of a parison. As used herein, the term "parison" means an extruded tube of plastic or polymer. Further preferred, is a method wherein the dispensing container is formed from a single piece of polymer. However, the parison is optionally formed from a single polymer, a blend of two or more polymers, or a multilayer structure comprising two or more layers of the same or different polymers. The polymeric materials may be used as a single layer in a monolayer structure for the present device, or as a layer in a multi-layer structure. The multi-layer structure may be manufactured using co-extrusion. The multi-layer structure may consist of any combination of polymers listed above and in any order and any frequency.

The step of forming a dispensing container can be accomplished by applying the mold around or onto the parison and applying a vacuum to the mold surface followed by the application of compressed gas or vacuum to the mold. In an embodiment of the present method, the step of closing the mold can form the breakable seal [270] and integral tab [272] to seal the outlet [220] of the container. Alternatively, the step of closing the mold can seal one end of the reservoir by forming the tail [290] of the dispensing container. The operation of a blow-fill-seal system to form aseptic packages is well known in the art.

One feature of the present method is the control of the thickness of the walls of the squeezable reservoir. This parameter, along with the characteristics of the polymer that is used, controls the degree of pressure that is required to collapse the walls of the reservoir and express the liquid [301] from the outlet [220] of the device, after the breakable seal is removed. In one embodiment, the thickness of the wall of the squeezable reservoir is from about 0.01 mm to about 5 mm, preferably from about 0.01 mm to about 3 mm, and more preferably from about 0.05 to about 1 mm.

The polymer is typically extruded from the outlet of an extruder at a temperature that is above its glass transition temperature and in the form of a parison. The polymer then enters the blow mold at or very near this temperature. It is preferred that the temperature of the polymer entering the blow mold is between about 50° C. and about 1000° C., more preferred is a temperature of between about 100° C. and about 500° C., and even more preferred is a temperature between about 100° C. and about 300° C. The exact temperature of the polymer entering the blow mold depends on the polymer chosen and the operating conditions and parameters of the molding and filling process, As discussed above, the present method can also include the step of adding a head-space gas to the reservoir. Although the gas can be added at any temperature, it is preferred that the head-space gas is added to the reservoir at a temperature of between about 10° C. and 500° C., preferably between about 100° C. and about 500° C., and even more preferably between about 100° C. and about 300° C.

When the liquid is added to the reservoir, it can be added at any temperature at which it is stable, but often the liquid is added to the dispensing container at a temperature of from about 2° C. to about 65° C., and preferably from about 10° C. to about 50° C., and most preferably from about 15° C. to about 25° C.

The process may be carried out so that a sterile product is formed. For example, depending upon the sterility requirements of the liquid, the sterility of the liquid and gas in the reservoir can be closely controlled to yield a sterile charge in the reservoir.

When gas and/or liquid has been added to the reservoir, the dispensing container can be sealed by the action of an additional die that closes to seal the container. Preferably this step can be used to form a substantially flat tail [290] that is disposed from the reservoir opposite the dispensing head and in a plane that is substantially parallel to the plane of the dispensing head.

The molded, filled and sealed dispensing container is allowed to cool in the mold sufficiently to retain its shape, and then the mold is opened and the device is removed. Any desirable printing, labeling, or other information that is to be added to the device is then applied. When the device is ready for use, it can be packaged for storage, shipment, sale and use.

The present dispensing container is easily used by breaking the breakable seal and removing the removable part of the seal and the tab and inserting the dispensing head into the mouth, ear, nose, eye, or other orifice, of the user into which the contents of the device are to be deposited, and using the fingers, or thumb and fingers, to squeeze the squeezable reservoir and express the liquid contents from the outlet.

General Procedures: Calculation of Squeezing Force and Resulting Fluid Pressure

Figure 14:
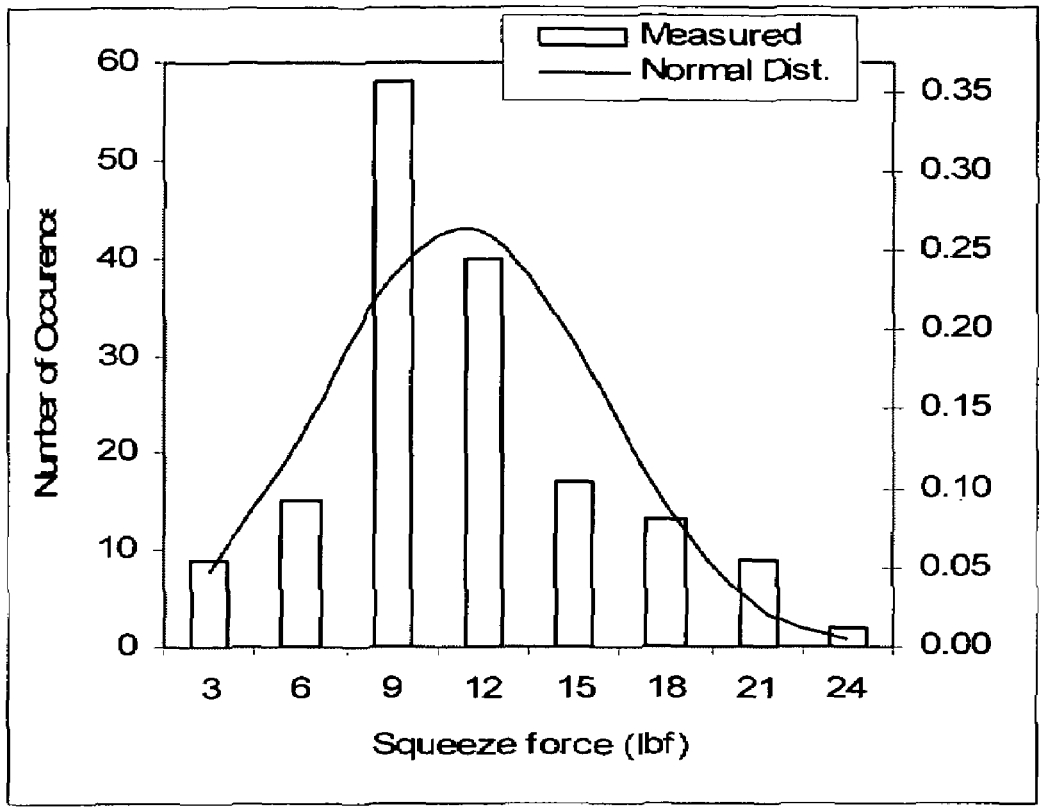
FIG. 14 is a graph of the squeezing force exerted during a number of tests by different adults on a pressure-sensing device shaped like an embodiment of a flow-controlled dispensing container of the present invention as a function of the number of occurrences of each force, and also showing the normal distribution of the results.

To determine the squeeze force a normal user imparts onto the reservoir body [201] a group of 40 participants were involved in determining the force seen while squeezing the device. Each participant held a typical representation of the invention and was asked to squeeze the device in a typical manner. Once the participant was accustomed to the device, they were then asked to move to a load-cell, shaped like the device, and squeeze it a number of times. A sample size of N=163 squeezes was collected. FIG. 14 shows a histogram of the results with the frequency and recorded squeeze force in pounds. This data indicated that a normal adult exerted about 10 lbf on the device during squeezing.

Figure 15:
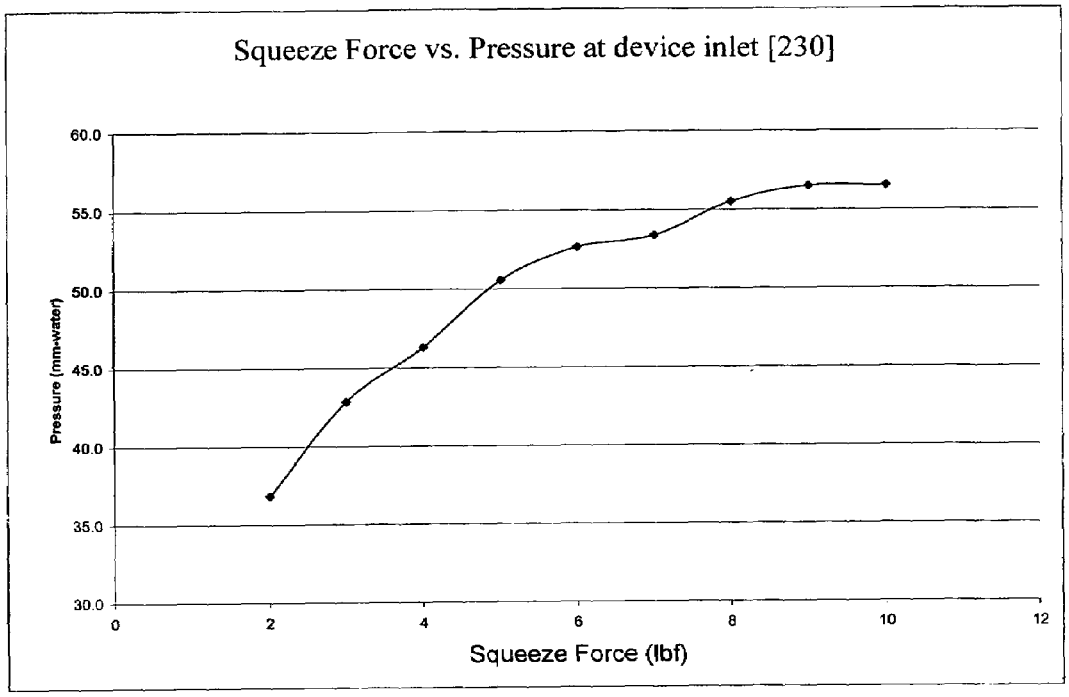
FIG. 15 is a graph of the pressure at the outlet of an embodiment of the flow-controlled dispensing container of the present invention versus the squeezing force exerted on the squeezable reservoir.

Next, a mechanical squeeze device was constructed to mimic a repeatable squeeze applied to the reservoir [201]. A pressure tap was placed at the inlet [230] to determine the gage pressure seen when a squeeze force was applied to the reservoir [201]. FIG. 15 shows the results of the pressure (mm-water) when the reservoir is squeezed. FIG. 15 shows that for a squeezing force of about 10 lbf, one can expect a pressure at the inlet of about 57 mm $H_2O$.

EXAMPLE 1

This example illustrates the calculation of the dimensions of the flow control system of the present invention.

To illustrate how the outlet velocity can be influenced by the physical structure of the invention, a representative case is presented. The case involves a dual channel passage [240] as shown, for example, in FIGS. 10A-10D. For this case, the physical structure is constructed with channel lengths [240] L=33 mm+33 mm=66 mm total cumulative length, channel diameter, $D_{ch}$=3.3 mm and $D_{out}$=1.9 mm. Fluid properties close to water are used in the model; namely, absolute viscosity, $\mu$=1 centipoise at 20° C. and density, $\rho$=1000 kg/m$^3$ at 20° C. For this physical structure, a 10 lbf squeeze creates a 57-mm-of-water reservoir pressure (see FIG. 15), resulting in a Reynolds number, Re=4600 indicating turbulent flow and an average fluid velocity in the channel, $v_{avg}$=1.2 m/sec, which leads to a $v_{out}$=7.6 m/s. If the viscosity of the fluid increases to 1000 centipoise and density=1200 kg/m$^3$ (typical of children's suspension medicine) the physical structure of the same system yields an outlet velocity $v_{out}$=2.7 m/s. This outlet velocity falls outside the 3 to 8 m/s oral delivery desired range. To address this situation, several physical dimensions of the system can be changed. Holding all other physical parameters constant for the above system, Table 1 shows how a change in a single parameter will affect the outlet velocity in order to get the outlet velocity back into the desired range.

TABLE 1

Illustration of how adjustment in a single flow control system parameter affects outlet velocity.

| Physical Parameter changed | Outlet Velocity (m/s) |
|---|---|
| L = 10 mm | 7.8 m/s |
| $D_{ch}$ = 4.8 mm | 7.5 m/s |
| $D_{out}$ = 1.1 mm | 7.6 m/s |

Using this same technique, one can vary any of the physical parameters of the flow control system to arrive at a system design that meets the criteria of the outlet velocity, delivery time, and resistance to leakage while not being squeezed, while also being economical and easy to manufacture.

All references cited in this specification, including without limitation all papers, publications, patents, patent applications, presentations, texts, reports, manuscripts, brochures, books, internet postings, journal articles, periodicals, and the like, are hereby incorporated by reference into this specification in their entireties. The discussion of the references herein is intended merely to summarize the assertions made by their authors and no admission is made that any reference constitutes prior art. Applicants reserve the right to challenge the accuracy and pertinency of the cited references.

In view of the above, it will be seen that the several advantages of the invention are achieved and other advantageous results obtained.

As various changes could be made in the above methods and compositions by those of ordinary skill in the art without departing from the scope of the invention, it is intended that all matter contained in the above description and shown in the accompanying drawings shall be interpreted as illustrative and not in a limiting sense. In addition it should be understood that aspects of the various embodiments may be interchanged both in whole or in part.

What is claimed is:

1. A flow-controlled dispensing container fillable with a liquid, the container comprising:

a squeezable reservoir for holding the liquid prior to dispensing;

a dispensing head that appears substantially flat in profile wherein the head is integral with the sgueezable reservoir and wherein the head has a distal end and a proximal end;

an outlet that is interconnected with the reservoir by a passage at an inlet and wherein the outlet is at the distal end of the dispensing head and the inlet is at the proximal end, wherein the outlet is sealed with a breakable seal which reveals the outlet when broken;

a stop disposed near the proximal end of the dispensing head to prevent over-insertion of the dispensing head into a user's mouth when the container is used to dispense the liquid to the user; and a flow control system comprising the inlet to the passage, the passage, and the outlet that dispenses the liquid at a desired outlet velocity and within a desired delivery time when the squeezable reservoir is squeezed, wherein the flow control system comprises a single inlet with a cross-section area sufficient to retain fluid in the reservoir by action of surface tension, and having two passages each having a semi-circular path through the dispensing head and discharging through a single outlet which has a cross-section area sufficient to retain fluid in the passage by action of surface tension of the liquid when the breakable seal is broken, wherein the cross-section areas, lengths, and surface roughness of the inlet, outlet and passage are designed to act together to control the outlet velocity and delivery time of the discharged liquid.

2. The dispensing container according to claim 1, wherein the dispensing container is unitary.

3. The dispensing container according to claim 1, wherein the desired outlet velocity is within a range of from about 2 m/s to about 15 m/s.

4. The dispensing container according to claim 1, wherein the desired outlet velocity is within a range of from about 5 m/s to about 10 m/s.

5. The dispensing container according to claim 1, wherein the desired delivery time is within a range of from about 0.5 sec. to about 4 sec.

6. The dispensing container according to claim 1, wherein the desired delivery time is within a range of from about 1 sec. to about 2 sec.

7. The dispensing container according to claim 1, wherein said passage comprises multiple passages.

8. The dispensing container according to claim 1, wherein said passage has a rippling undulating shape.

9. The dispensing container according to claim 1, wherein said passage has a serpentine shape.

10. The dispensing container according to claim 1, wherein said passage comprises a maze.

11. The dispensing container according to claim 1, wherein the dispensing head has a bottom surface and a top surface one or both of which has an indented portion.

12. The dispensing container according to claim 1, wherein the top surface and the bottom surface of the dispensing head have matching indented portions that define the shape of the passage that interconnects the squeezable reservoir and the outlet.

13. The dispensing container according to claim 12, wherein the matching indented portions define the shape of the passage that interconnects the squeezable reservoir and the outlet as a single channel interconnecting the squeezable reservoir and the outlet, where the channel is flanked on either side by a curved portion forming a side of the dispensing head and having rounded edges.

14. The dispensing container according to claim 1, wherein the breakable seal is integral with a tab which is designed for gripping between the thumb and forefinger for the purpose of breaking the seal.

15. The dispensing container according to claim 1, further comprising a substantially flat tail disposed from the reservoir opposite the dispensing head and in a plane that is substantially parallel to the plane of the dispensing head.

16. The dispensing container according to claim 1, further comprising a liquid in the squeezable reservoir.

17. The dispensing container according to claim 16, wherein the liquid comprises at least one material that is selected from vitamins, over-the-counter drugs, or prescription drugs.

* * * * *